US010951996B2

(12) United States Patent
Pedersen et al.

(10) Patent No.: US 10,951,996 B2
(45) Date of Patent: Mar. 16, 2021

(54) BINAURAL HEARING DEVICE SYSTEM WITH BINAURAL ACTIVE OCCLUSION CANCELLATION

(71) Applicant: GN HEARING A/S, Ballerup (DK)

(72) Inventors: Søren Christian Voigt Pedersen, Valby (DK); Jonathan Boley, Mundelein, IL (US); James Robert Anderson, Petersburg, FL (US)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 16/442,788

(22) Filed: Jun. 17, 2019

(65) Prior Publication Data

US 2020/0007995 A1 Jan. 2, 2020

(30) Foreign Application Priority Data

Jun. 28, 2018 (EP) ..... 18180461

(51) Int. Cl.
*H04R 25/00* (2006.01)

(52) U.S. Cl.
CPC ..... *H04R 25/505* (2013.01); *H04R 25/552* (2013.01); *H04R 25/604* (2013.01); *H04R 2225/41* (2013.01)

(58) Field of Classification Search
CPC .. H04R 25/505; H04R 25/356; H04R 25/552; H04R 25/604; H04R 25/453; H04R 2460/05; H04R 2225/41
See application file for complete search history.

(56) References Cited

U.S. PATENT DOCUMENTS

2009/0299742 A1* 12/2009 Toman ..... G10L 21/0208 704/233
2010/0027823 A1 2/2010 Arndt et al.
(Continued)

FOREIGN PATENT DOCUMENTS

EP 2 843 971 A1 3/2015
EP 3 185 588 A1 6/2017
EP 3 328 097 A1 5/2018

OTHER PUBLICATIONS

Liebich et al. ("AOC with Hear-Through Equalization for Headphones"), Apr. 15-20, 2018, IEEE https://ieeexplore.ieee.org/stamp/stamp.jsp?tp=&arnumber=8461834 (Year: 2018).*
(Continued)

*Primary Examiner* — Yogeshkumar Patel
(74) *Attorney, Agent, or Firm* — Vista IP Law Group, LLP

(57) ABSTRACT

A binaural hearing system includes a first hearing device and a second hearing device, each of which comprising: an input transducer; a transducer audio signal processor configured to provide a processed input transducer audio signal; an ear canal microphone; an ear canal audio signal processor configured to provide a processed ear canal audio signal; a first signal combiner configured to combine the processed input transducer audio signal with the processed ear canal audio signal to obtain an output transducer audio signal; a signal level detector configured to determine a signal level of (1) the output transducer audio signal or (2) an audio signal included in formation of the output transducer audio signal; and an output transducer; wherein the binaural hearing system further comprises a binaural excessive level detector connected to the first hearing device's signal level detector and the second hearing device's signal level detector.

20 Claims, 6 Drawing Sheets

(56) References Cited

U.S. PATENT DOCUMENTS

| | | | | |
|---|---|---|---|---|
| 2015/0063612 | A1* | 3/2015 | Petersen | H04R 25/50<br>381/313 |
| 2018/0184219 | A1* | 6/2018 | Van Der Werf | H04R 25/652 |

OTHER PUBLICATIONS

European Extended Search Report dated Dec. 13, 2018 for corresponding European Patent Application No. 18180461.8.

* cited by examiner

BINAURAL HEARING DEVICE SYSTEM WITH BINAURAL ACTIVE OCCLUSION CANCELLATION

RELATED APPLICATION DATA

This application claims priority to, and the benefit of, European Patent Application No. 18180461.8 filed on Jun. 28, 2018. The entire disclosure of the above application is expressly incorporated by reference herein.

FIELD OF TECHNOLOGY

A novel binaural hearing device system (or binaural hearing system) is disclosed that performs binaural active occlusion cancellation.

BACKGROUND

The occlusion effect is the changed perception of sound generated inside the body of a human, e.g. by the human's own voice, jaw motion, impact sound, e.g. caused by walking or running or hitting something, caused by inserting a mould or a shell into the human's ear canal that occludes the ear canal. When sound is generated inside the body of a human, e.g. when the human speaks, the soft tissue in the ear canal is excited by vibration energy propagated by the skull and jaw, and since the energy cannot escape the ear canal due to the occlusion or partial occlusion, the vibrating soft tissue generates an increased sound pressure within the ear canal relative to an open ear canal.

Depending on individual geometry, the occlusion effect may cause amplification of low frequencies, e.g. below 1 kHz, of up to 30 dB.

For open fits, i.e. moulds or shells that allow air passage through or around them when inserted in the ear canal, occlusion is not a problem. However, there may be situations where open fits are not feasible, e.g., due to gain or output power limitations, or when the ear canal must be sealed for protective purposes.

When conventional solutions (larger vents, deep fitting, etc.) fail, Active Occlusion Cancellation (AOC) may be a viable alternative.

Hearing aids with AOC are disclosed in U.S. Pat. No. 4,985,925, EP 1 129 600, WO 2006/037156, WO 2008/043792, U.S. Pat. No. 6,937,738, US 2008/0063228, WO 2008/043793, EP 2 309 778, Mejia, Jorge et al., "The occlusion effect and its reduction", Auditory signal processing in hearing-impaired listeners, 1st International Symposium on Auditory and Audiological Research (ISAAR 2007), ISBN: 87-990013-1-4, and Meija, Jorge et al., "Active cancellation of occlusion: An electronic vent for hearing aids and hearing protectors", J. Acoust. Soc. Am. 124(1), 2008.

Common for these approaches is that, an "ambient sound" received at the ambient microphone, is processed by a hearing loss processor to compensate for the hearing loss of a user to generate a desired sound, is combined with an compensation signal captured by a microphone in the user's partly or fully occluded ear canal volume in such a way that the sum of these signals suppresses the perceived excess body conducted sound.

EP 2 434 780 A1 discloses a hearing aid with a receiver (a small loudspeaker is denoted a receiver in accordance with hearing aid terminology) having a low cut-off frequency, e.g. less than 10 Hz, or being capable of holding a static pressure in a sealed volume in order to perform AOC at very low frequencies for cancellation of high amplitude subsonic signals in the residual volume of the occluded ear canal primarily due to jaw motion. Jaw motion changes the shape and thus volume of the residual volume of the ear canal, generating undesirable subsonic pressure signals that can have extremely high amplitudes. These signals may overload the output amplifier or receiver when the AOC circuit attempts to cancel them, creating audible artefacts, and wasted battery energy. Even if overload does not occur, these large signals waste the dynamic range of the output amplifier and receiver that are needed for effective occlusion cancellation.

Evidence suggests that occlusion related complaints are significant contributors to dissatisfaction with hearing aids as well as reasons for not acquiring hearing aids.

In Jespersen, Charlotte Thunberg, et al. "The occlusion effect in unilateral versus bilateral hearing aids." Journal of the American Academy of Audiology, Volume 17, Number 10, 2006: 763-773, it has been shown that subjective occlusion is worse for bilateral than for unilateral fittings.

Users of hearing devices, such as protection devices, hearing aids, headsets, etc., typically experience subjective occlusion.

SUMMARY

An Active Occlusion Cancellation (AOC) circuit or an Active Noise Cancellation (ANC) circuit or a feedback cancellation circuit or the like can be over-driven if the signal to be cancelled has high amplitude. The resulting cancellation signal may be even higher in amplitude, and may exceed the dynamic range of certain components of the system and thereby cause distortion.

Further, an operating AOC circuit increases the noise level. This will especially be audible for people with normal hearing or mild hearing loss, and will be even more audible in quiet (e.g. using hearing protection).

There is a need for a cancellation circuit, such as an AOC circuit, an ANC circuit, a feedback cancellation circuit, etc., that prevents audio signals of the circuit from exceeding the dynamic range of one or more components of the circuit.

There is a need for an AOC circuit that minimizes occlusion, distortion, and noise.

There is a need for an AOC circuit that provides reliable detection of presence of binaural occlusion and provides binaural occlusion cancellation in such a way that binaural artefacts are avoided.

Binaural artefacts caused by known AOC circuits include user perception of noise moving from one ear to the other, and that the own voice sounds differently in the two ears, and other bothering effects.

Binaural artefacts seem to be due to individual operation of AOC circuits at the two ears of the user.

There is a need for an ANC circuit that prevents audio signals of the circuit from exceeding the dynamic range of one or more components of the circuit.

There is a need for an ANC circuit that provides reliable detection of presence of binaural noise and provides binaural noise suppression in such a way that binaural artefacts are avoided.

Binaural artefacts caused by known ANC circuits include user perception of noise moving from one ear to the other, and other bothering effects.

Binaural artefacts seem to be due to individual operation of ANC circuits at the two ears of the user.

Method

A novel method of binaural cancellation of undesired signals, such as binaural active occlusion cancellation, binaural noise cancellation, binaural feedback cancellation, etc., is provided that alleviates discomfort caused by the signal cancellation, and a novel binaural hearing device system is provided that operates in accordance with the novel method.

The novel method of binaural cancellation of undesired signals, such as binaural active occlusion cancellation, binaural noise cancellation, binaural feedback cancellation, etc., comprises the steps of converting external sound received outside an ear canal into an input transducer audio signal at both ears of a user, converting sound received inside the ear canal into an ear canal microphone audio signal at both ears of the user, determining a signal level inside the ear canal of the ear canal microphone audio signal at both ears of the user, processing each of the ear canal microphone audio signals into respective processed ear canal microphone audio signals at both ears of the user, combining the input transducer audio signal with the respective processed ear canal audio signal into an output transducer audio signal, e.g. for active occlusion cancellation, at both ears of the user, converting the output transducer audio signal into an output sound signal for emission towards an eardrum at both ears of the user, and wherein the method further comprises the steps of determining a signal level of at least one of the output transducer audio signal and an audio signal included in the formation of the output transducer audio signal at both ears of the user, and wherein the step of processing is performed in response to the detected signal levels at both ears of the user.

Each of the ear canal microphone audio signal, the processed ear canal audio signal, and the processed input transducer audio signal constitutes an audio signal included in the formation of the output transducer audio signal.

The step of processing may be performed such that none of the output transducer audio signals; or, audio signals included in the formation of the output transducer audio signals, exceed, or generate a signal that exceed, a predetermined dynamic range, such as the dynamic range of one or more components of a circuit performing the method.

The method may further comprise the step of dividing each of the input transducer audio signals and each of the ear canal microphone audio signals into a plurality of frequency bands, and the step of detecting the presence of binaural occlusion may comprise detecting the presence of binaural occlusion in selected frequency bands of the ear canal microphone audio signals.

The frequency bands may be warped frequency bands or non-warped frequency bands.

The step of dividing each of the input transducer audio signals and each of the ear canal microphone audio signals into a plurality of frequency bands may comprise subjecting the audio signals to a frequency transformation.

The step of detecting presence of binaural occlusion may be performed in the frequency domain.

The frequency transformation may be a warped frequency transformation.

The frequency transformation may be a Warped Fourier Transformation, a Warped Discrete Fourier Transformation, a Warped Fast Fourier Transformation, etc.

The warped frequency bands may correspond to the Bark frequency scale of the human ear.

The frequency transformation may be a non-warped frequency transformation.

The frequency transformation may be a Fourier Transformation, such as a Discrete Fourier Transformation, a Fast Fourier Transformation, etc.

The frequency bands of the input transducer audio signals may be different from the frequency bands of the ear canal microphone audio signals.

Different frequency transformations may be applied to the input transducer audio signals and the ear canal microphone audio signals.

The frequency bands of the input transducer audio signals may be identical to the frequency bands of the ear canal microphone audio signals.

Identical frequency transformations may be applied to the input transducer audio signals and the ear canal microphone audio signals.

Binaural Hearing Device

Throughout the present disclosure, the words "adapt" and "configure" are used synonymously and may substitute each other.

The novel binaural hearing device system comprises a binaural hearing device with a first hearing device and a second hearing device, each of which comprises An input transducer, e.g. a set of external microphones, e.g. constituted by a single microphone, a radio for reception of streamed audio, a telecoil, etc., for provision of the input transducer audio signal, an ear canal microphone for provision of the ear canal microphone audio signal in response to sound received inside the ear canal of the user wearing the binaural hearing device, an ear canal audio signal processor configured for processing the ear canal audio signal into a processed ear canal audio signal, a signal combiner configured for combining the input transducer audio signal, possibly processed, with the processed ear canal audio signal into an output transducer audio signal, e.g. for active occlusion cancellation, a signal level detector for determining a signal level of an audio signal selected from the group consisting of the output transducer audio signal and an audio signal included in formation of the output transducer audio signal, and an output transducer configured for converting the output transducer audio signal into an acoustic sound signal for emission towards an eardrum of the user, and wherein the binaural hearing device system further comprises a binaural excessive level detector connected to the signal level detector of the first hearing device and the signal level detector of the second hearing device for reception of the detected signal levels, and configured for outputting a first control signal to the ear canal audio signal processor of the first hearing device and a second control signal to the ear canal audio signal processor of the second hearing device in response to the detected signal levels, and wherein the ear canal audio signal processor in each of the first and second hearing devices is configured for processing the ear canal microphone audio signal in response to the respective one of the first and second control signals of the binaural excessive level detector.

Each of the ear canal microphone audio signal, the processed ear canal audio signal, and the processed input transducer audio signal constitutes an audio signal included in the formation of the output transducer audio signal.

For example, the ear canal audio signal processor in each of the first and second hearing devices may be configured for processing the ear canal microphone audio signal in response to the respective one of the first and second control signals of the binaural excessive level detector in such a way that at least one of the processed ear canal audio signals is attenuated by an amount required to keep signals of the first and second hearing devices within the dynamic range of the respective one of the first and second hearing devices.

The binaural hearing device system may be configured to operate in such a way that none of the output transducer audio signals; or, audio signals included in the formation of the output transducer audio signals, exceed, or generate a signal that exceed, a predetermined dynamic range, such as the dynamic range of one or more components, of the binaural hearing device system.

The ear canal audio signal processor in each of the first and second hearing devices may be configured for processing the respective ear canal microphone audio signal in response to the respective one of the first and second control signals of the binaural excessive level detector in such a way that each of the processed ear canal audio signals is attenuated by a same amount required to keep signals of the first and second hearing devices within the dynamic range of the respective one of the first and second hearing devices.

The binaural hearing device may be a binaural hearing aid, wherein each of the first and second hearing devices is a hearing aid, e.g., a hearing aid of any type that is configured to be head worn at an ear of a user of the hearing aid, such as a Behind-The-Ear (BTE), a Receiver-In-the-Ear (RIE), an In-The-Ear (ITE), an In-The-Canal (ITC), a Completely-In-the-Canal (CIC), etc., hearing aid.

Input Transducer

The input transducer may comprise a set of external microphones for provision of the input transducer audio signal in response to external sound and positioned outside the ear canal of a user wearing the binaural hearing device, wherein the input transducer audio signal is formed by combination of the output signals of the external microphones of the set of external microphones as is well-known in the art of hearing devices.

A single external microphone may constitute the set of external microphones in which case the output signal of the single external microphone constitutes the input transducer audio signal.

A directional microphone array comprising omni-directional microphones, e.g, a front microphone and a rear microphone, the output signal of which is delayed and added to the output signal of the front microphone as is well-known in the art of hearing devices, may constitute the set of external microphones.

Instead, or additionally, the input transducer may comprise a radio with an antenna for reception of streamed audio transmitted wirelessly to the binaural hearing device system from various types of transmitters, such as mobile phones, radios, TV sets, media players, companion microphones, broadcasting systems, such as in a public place, e.g. in a church, an auditorium, a theatre, a cinema, etc., public address systems, such as in a railway station, an airport, a shopping mall, etc., etc. The radio retrieves digital audio from the received wireless signal and provides the digital audio as the input transducer audio signal having a high signal to noise ratio.

Instead, or additionally, the input transducer may comprise a telecoil for magnetically pick up an input transducer audio signal generated, e.g., by telephones, FM systems (with neck loops), and induction loop systems (also called "hearing loops"); whereby sound may be transmitted to hearing devices with a high signal to noise ratio.

The input transducer may include an input selector for selection of the input transducer audio signal among a plurality of sources, such as various combinations of external microphones, one of which may be one omni-directional microphone and another may be two omni-directional microphones coupled as a directional microphone array, etc., and a radio, and a telecoil, etc.

The input transducer may include a mixer for reception of a plurality of transducer audio signals from a plurality of sources, such as various combinations of external microphones, one of which may be one omni-directional microphone and another may be two omni-directional microphones couples as a directional microphone array, etc., and a radio, and a telecoil, etc.; and providing a weighted sum of the received audio signals as the input transducer audio signal.

Signal Processing

Each of the first and second hearing devices may comprise a transducer audio signal processor configured for processing of sound received by the hearing device in a way that is suitable for the intended use of the hearing device. For example, when the hearing device is a hearing aid, the input transducer audio signal processor is configured for compensation of the hearing loss of the user wearing the binaural hearing device system. As is well known in the art, the processing of the input transducer audio signal processor may be controlled by various selectable signal processing algorithms each of which having various parameters for adjustment of the actual signal processing performed. A gain in a hearing aid is an example of such a parameter.

The flexibility of the transducer audio signal processor is often utilized to provide a plurality of different algorithms and/or a plurality of sets of parameters of a specific algorithm. For example, various algorithms may be provided for noise suppression, i. e. attenuation of undesired signals and amplification of desired signals. Desired signals are usually speech or music, and undesired signals can be background speech, restaurant clatter, music (when speech is the desired signal), traffic noise, etc.

The different algorithms and parameter sets are typically included to provide comfortable and intelligible reproduced sound quality in different sound environments, such as speech, babble speech, restaurant clatter, music, traffic noise, etc. Audio signals obtained from different sound environments may possess very different characteristics, e. g. average and maximum sound pressure levels (SPLs) and/or frequency content. Therefore, in each of the first and second hearing devices, various sound environments may be associated with particular respective programs wherein a particular setting of algorithm parameters of a signal processing algorithm provides processed sound of optimum signal quality in a specific sound environment. A set of such parameters may typically include parameters related to broadband gain, corner frequencies or slopes of frequency-selective filter algorithms and parameters controlling e. g. knee-points and compression ratios of Automatic Gain Control (AGC) algorithms.

Consequently, the transducer audio signal processor of the first and second hearing devices may be provided with a number of different programs, each program tailored to a particular sound environment or sound environment category and/or particular user preferences.

In a hearing aid, signal processing characteristics of each of these programs is typically determined during an initial fitting session in a dispenser's office and programmed into the hearing aid by activating corresponding algorithms and algorithm parameters in a non-volatile memory area of the hearing aid and/or transmitting corresponding algorithms and algorithm parameters to the non-volatile memory area.

In each of, or one of, the first and second hearing devices, the transducer audio signal processor may be configured for dividing the audio signal into a plurality of non-warped frequency bands, e.g. utilizing a filter bank, e.g. a filter bank with linear phase filters.

In each of, or one of, the first and second hearing devices, the transducer audio signal processor may be configured for dividing the audio signal into a plurality of warped frequency bands, e.g. utilizing a filter bank with warped filters.

In each of, or one of, the first and second hearing devices, the transducer audio signal processor may be configured for dividing the audio signal into the plurality of frequency bands by subjecting the audio signal to a frequency transformation, such as a Fourier Transformation, such as a Discrete Fourier Transformation, a Fast Fourier Transformation, etc., or a Warped Fourier Transformation, a Warped Discrete Fourier Transformation, a Warped Fast Fourier Transformation, etc.

The warped frequency bands of each of the transducer audio signal processors of the first and second hearing devices may correspond to the Bark frequency scale of the user ear. Signal processing in the novel binaural hearing device system may be performed by dedicated hardware or may be performed in one or more signal processors, or performed in a combination of dedicated hardware and one or more signal processors.

Each of the ear canal audio signal processor and the transducer audio signal processor of the first and second hearing devices may form part of the same signal processor of the respective first and second hearing devices.

Signal processing performed by the binaural hearing device system may be performed by one common signal processor, for example located in a housing of one of the first and second hearing devices or in another housing of the binaural hearing device system or in another device, such as a wearable device, such as a smartwatch, an activity tracker, a hand-held device, such as a smartphone, a remote control, etc., etc.

Signal processing may also be performed by a plurality of signal processors, each of which, or parts of which, may be located in a housing of one of the first and second hearing devices or in another housing of the binaural hearing device system or in another device, such as a wearable device, such as a smartwatch, an activity tracker, a hand-held device, such as a smartphone, a remote control, etc., etc.

For example, each of the first and second hearing aids may have a housing that accommodates a hearing loss processor that is configured to process the audio signal into a hearing loss compensated audio signal compensating for the hearing loss of the user and provided to the output transducer for conversion into a sound signal for emission to the eardrum of a user, while the binaural excessive level detector may be located in a smartphone communicating wirelessly with the first and second hearing devices.

As used herein, the terms "processor", "central processor", "hearing loss processor", "signal processor", "controller", "system", etc., are intended to refer to CPU-related entities, either hardware, a combination of hardware and software, software, or software in execution. For example, a "processor", "signal processor", "controller", "system", etc., may be, but is not limited to being, a process running on a processor, a processor, an object, an executable file, a thread of execution, and/or a program.

By way of illustration, the terms "processor", "central processor", "hearing loss processor", "signal processor", "controller", "system", etc., designate both an application running on a processor and a hardware processor. One or more "processors", "central processors", "hearing loss processors", "signal processors", "controllers", "systems" and the like, or any combination hereof, may reside within a process and/or thread of execution, and one or more "processors", "central processors", "hearing loss processors", "signal processors", "controllers", "systems", etc., or any combination hereof, may be localized in one hardware processor, possibly in combination with other hardware circuit, and/or distributed between two or more hardware processors, possibly in combination with other hardware circuit.

Also, a signal processor (or similar terms) may be any component or any combination of components that is capable of performing signal processing. For examples, the signal processor may be an ASIC processor, a FPGA processor, a general purpose processor, a microprocessor, a circuit component, or an integrated circuit.

Binaural Excessive Level Detector

With the binaural excessive level detector, it is possible to distinguish between some types of one-sided cancellation of undesired signals, e.g. caused by occurrences of noise and/or occlusion, i.e. noise and/or occlusion occurring at one of the ears of the user, but not at the other ear of the user, e.g. caused by wind noise, user button operations, scratching helmet, etc., and two-sided cancellation of undesired signals, e.g. caused by binaural noise and/or occlusion, wherein noise and/or occlusion occurs binaurally, i.e. simultaneously at both ears of the user.

The binaural excessive level detector may be configured for provision of one or more control signals for each of the first and second hearing devices for setting signal processing parameters of the ear canal audio signal processor of the first and second hearing devices and possibly also of other signal processing parts of the first and second hearing devices so that the first and second hearing devices of the binaural hearing device system perform coordinated cancellation of undesired signals, such as active occlusion cancellation.

The processed ear canal audio signal may be subtracted from the processed input transducer audio signal in order to cancel the undesired signal, e.g. in order to cancel occlusion. However, the sound level in the ear canal may have high magnitude and the output transducer audio signal may then have corresponding high amplitude that may exceed the dynamic range of the output transducer and/or an amplifier or of other components of the hearing device circuit, and thereby cause distortion. This may be avoided by attenuation of the output transducer audio signal.

Each of the first and second hearing devices may have a signal level detector for determination of a sound level of at least one of the output transducer audio signal and another audio signal included in the formation of the output transducer audio signal. The binaural excessive level detector may be connected to the signal level detectors for reception of the determined signal level and may additionally compare each of the determined sound levels with a threshold, and in the event that one or both of the signal levels exceed the threshold, the control signals for each of the first and second hearing devices may control the respective ear canal audio signal processor to attenuate each of the processed ear canal audio signals with the same amount, e.g. in dB, in such a way that both of the determined signal levels are lowered so that audio signals of the first and second hearing devices are kept within the dynamic range of the first and second hearing devices.

Thus, an undesired signal, e.g. causing binaural occlusion, may be suppressed by coordinated signal processing parameter adjustment, whereby binaural artefacts, such as user perception of noise moving from one ear to the other, user perception that the own voice sounds differently in the two ears, and other bothering effects, are avoided or at least suppressed Parts of the binaural excessive level detector may be included in the first and second hearing devices.

For example, the first hearing device may comprise a first part of the binaural excessive level detector and the second hearing device may comprise a second part of the binaural excessive level detector, wherein the first part of the binaural excessive level detector is connected to the signal level detector of the first hearing device and the signal level detector of the second hearing device for reception of the output signals with the determined signal levels, and configured for outputting the first control signal to the ear canal audio signal processor of the first hearing device in response to the determined signal levels, and wherein the second part of the binaural excessive level detector is connected to the signal level detector of the first hearing device and the signal level detector of the second hearing device for reception of the output signals with the determined signal levels, and configured for outputting the second control signal to the ear canal audio signal processor of the second hearing device in response to the determined signal levels.

Alternatively, or additionally, parts of the binaural excessive level detector may be included in another device, such as a wearable device, such as a smartwatch, an activity tracker, a hand-held device, such as a smartphone, etc., etc.

For example, the binaural hearing device system may comprise a wearable device that is interconnected with the first and second hearing devices and comprises the binaural excessive level detector.

Body Conducted Sound Detector

The binaural hearing device system may include at least one body conducted sound detector that is configured for detection of sound in the ear canal of the user that originates from the user's own body, in the following denoted body conducted sound, for example originating from the user's own voice, jaw motion, body impact, e.g. caused by walking, running, falling, etc.

Separation of body conducted sound from external sound may be performed by subjecting the input transducer audio signal and the ear canal microphone audio signal of each of the first and second hearing devices to a blind source separation (BSS) algorithm.

Generally, blind source separation, such as Independent Component Analysis (ICA), Principal Component Analysis (PCA), Singular Value Decomposition (SVD), Non-Negative Matrix Factorization (NMF or NNMF), etc., is a technique for separating mixed source signals (components) which are presumably statistically independent from each other. In its simplified form, blind source separation applies an "un-mixing" matrix of weights to the mixed signals, for example, multiplying the matrix with the mixed signals, to produce separated signals. The weights are assigned initial values, and then adjusted to maximize joint entropy of the signals in order to minimize information redundancy. This weight-adjusting and entropy-increasing process is repeated until the information redundancy of the signals is reduced to a minimum. Because this technique does not require information on the source of each signal, it is referred to as "blind source separation". An introduction to blind source separation is found, for example, in US 2005/0060142A1.

The BSS algorithm's estimate of body conducted sound may include the user's own voice, sound caused by jaw movement, impact sound, etc.

In accordance with a second possibility, the at least one body conducted sound detector may perform signal processing based on pre-defined processing steps that process the input transducer audio signal and the ear canal microphone audio signal into an estimate of external sound and an estimate of body conducted sound originating from the body of the user, such as the user's own voice, jaw motion, impact sound generated, e.g., when walking. Such processing steps are disclosed in further detail below with reference to the drawings.

The at least one body conducted sound detector may comprise an acceleration sensor and/or a vibration sensor in one of, or in each of, the first and second hearing devices for detection of body conducted sound.

The at least one body conducted sound detector may provide output signals to the binaural excessive level detector providing information to the binaural excessive level detector on whether body conducted sound is detected in one or both ears of the user wearing the binaural hearing device system, and possibly the type of body conducted sound detected, such as the user's own voice, sound caused by jaw movement, impact sound, etc.

The binaural excessive level detector may be configured for provision of control signals that disable the AOC circuit, i.e. disable subtraction of the processed ear canal audio signal from the, possibly processed, input transducer audio signal of the first and second hearing devices when no body conducted sound is detected in any of the ears of the user.

In this way, it is possible to distinguish between one-sided occurrences of body conducted sound, i.e. body conducted sound occurring at one of the ears of the user, but not at the other ear of the user, e.g. caused by wind noise, user button operations, scratching helmet, etc., and two-sided, binaural body conducted sound caused by, e.g., the user's own voice, jaw movement, body impact with another object, etc., that may lead to enablement of active occlusion cancellation in both the first and second hearing devices.

Binaural Impact Sound Detector

As disclosed in US 2010/0220881 A1, occlusion may also be caused by impact sound in the ear canal, e.g. generated by walking, running, or other types of body impact with another object, etc.

The at least one body conducted sound detector may include a binaural impact sound detector configured for detection of impact sound occurring simultaneously in both ears of the user and may provide the control signals in response to the detection of impact sound.

The binaural impact sound detector may be configured for identification of impact sound frequency patterns.

Alternatively, or additionally, the binaural impact sound detector may comprise an acceleration and/or vibration sensor in one of, or in each of, the first and second hearing devices, e.g. utilized for detection of user walking.

The binaural excessive level detector may provide control signals to the AOC circuit in each of the first and second hearing devices that disables active occlusion cancellation when the binaural impact sound detector detects impact sound in both ears of the user.

Binaural Active Occlusion Cancellation (AOC)

In each of the first and second hearing devices, the hearing device may comprise an AOC circuit configured for active occlusion cancellation, e.g., similar to the AOC circuit disclosed in U.S. Pat. No. 8,116,489 wherein an electro-acoustic system is disclosed that performs active occlusion cancellation at one ear of a user independently of possible occlusion cancellation performed at the other ear of the user; however, wherein the AOC circuit in each of the first and second hearing devices is additionally controlled by the control signals of the binaural excessive level detector. For example, a gain of the ear canal audio signal processor in each of the first and second hearing devices may be reduced, e.g. adaptively, by the same amount, e.g. in dB, in each of the first and second hearing devices in response to detection of excessive signal levels in one of the ears, or in both ears, by the binaural excessive level detector.

For example, at selected signal levels, the AOC circuit of first and second hearing devices may operate monaurally, i.e. independent of sound received at the other ear of the user. The binaural excessive level detector monitors signal levels in the first and second hearing devices and in the event that signal levels exceed a certain threshold, a gain of the ear canal audio signal processor of each of the first and second hearing devices is reduced, e.g. adaptively, by the same amount, e.g. in dB, e.g., the processed ear canal audio signals of the first and second hearing devices are attenuated by the same amount, e.g. in dB, in response to the control signals provided by the binaural excessive level detector.

In each of, or one of, the first and second hearing devices, the AOC circuit may be configured for reducing gain with the same amount, e.g. in dB, in a plurality of the frequency bands of the ear canal microphone audio signal in response to the control signals provided by the binaural excessive level detector.

In each of, or one of, the first and second hearing devices, the AOC circuit may be configured for reducing gain individually in a plurality of the frequency bands of the input transducer audio signal processor in response to the control signals provided by the binaural excessive level detector.

In each of, or one of, the first and second hearing devices, the AOC circuit may be configured for reducing gain as a function of broad-band power of the ear canal microphone audio signal in response to the control signals provided by the binaural excessive level detector.

In each of, or one of, the first and second hearing devices, signal processing parameters of the AOC circuit, such as the threshold of the binaural excessive level detector 10C, etc., may be adjustable in accordance with user inputs.

Acoustic Leakage Detection and Processing

The closure of the ear canal causing the occlusion effect may not be equally tight in both ears of the user, and thus may cause unequal acoustic leakage in the ear canals, and acoustic leakage may occur in one ear only.

Each of the hearing devices of the binaural hearing device system has a housing that accommodates the ear canal microphone and that is adapted to be positioned in an ear canal of the user whereby the ear canal microphone is positioned to sense the ear canal sound pressure in the ear canal space inside the fully or partly occluded ear canal between a distal portion of the housing and the ear drum. Acoustic leakage may result when the inserted housing does not exactly fit the shape of the ear canal so that air passage becomes possible through one or more passages occurring between the wall of the housing and the wall of the ear canal. In presence of acoustic leakage, sound pressure in the ear canal space inside the partly occluded ear canal escapes to some extent through the passage(s) so that the sound pressure in the ear canal decreases. The lower the frequency the more the sound pressure decreases. Thus, acoustic leakage is preferably detected at low frequencies, such as frequencies below 2 kHz, such as frequencies below 1 kHz, such as frequencies below 700 Hz, such as frequencies in the range between 100 Hz and 700 Hz, such as frequencies around 500 Hz.

Transfer functions of circuitry in the first and second hearing devices, wherein the transfer functions include a signal that is a function of the sound pressure in the ear canal may be used for determination of acoustic leakage in the ear canal.

For example, in the event that no acoustic leakage is present in one ear, a determined difference between the same transfer functions of the first and second hearing devices, for example a difference larger than a predetermined or adjustable threshold at one or more predetermined frequencies, may be attributed to acoustic leakage in the ear canal of the other ear. Determination of the difference is preferably performed with the same settings of the first and second hearing devices.

It may be assumed that the hearing device with the highest ear canal microphone audio signal level at the frequencies at which acoustic leakage is detected, exhibits no acoustic leakage.

Transfer functions of the first and second hearing devices utilized for acoustic leakage detection, may be determined, e.g. during fitting in a dispenser's office with the hearing devices properly mounted at the ears of the user without acoustic leakage, or a sealed calibration performed at the factory, in the following denoted reference transfer functions; and subsequently during normal use of the binaural hearing device system, a determined difference between the reference transfer functions previously determined without acoustic leakage and the respective currently determined transfer functions during use may be attributed to acoustic leakage for each of the first and second hearing devices in the respective ear canal of the user. For example, a difference larger than a predetermined or adjustable threshold at one or more predetermined frequencies may be attributed to acoustic leakage. Determination of the difference is preferably performed with the same settings of the first and second hearing devices during determination of the reference transfer functions and subsequently.

The signal level reduction controlled by the binaural excessive level detector at each ear of the user may be inversely proportional to the acoustic leakage at the frequencies at which the acoustic leakage is detected, in order to provide balanced occlusion cancellation in the two ears, wherein the obtained occlusion cancellation is the sum of cancellation by acoustic leakage and the active occlusion cancellation provided by subtracting each of the processed ear canal audio signals from the respective one of the processed input transducer audio signals. The acoustic leakage detection may take into account the response of the output transducer, and detection of a phenomenon in both ears of the user may take the difference in acoustic leakage of the two ears into account.

An acoustic leakage detector may be provided in each of the first and second hearing devices, each of which is configured for providing data on acoustic leakage to the binaural excessive level detector.

Each of the acoustic leakage detectors may be configured for determination of a transfer function that involves the sound pressure in the ear canal space inside the fully or partly occluded ear canal, for example a transfer function from the output of the input transducer to the input of the output transducer and/or a transfer function of a feedback loop from the input of the output transducer to the output of the input transducer and/or a transfer function from the input of the output transducer to the output of the ear canal microphone.

The acoustic leakage detector may be configured for determination of the respective transfer function of the respective first and second hearing devices with the same settings of the first and second hearing devices.

Each of the acoustic leakage detectors may be configured for outputting the determined transfer functions to the binaural excessive level detector, and the binaural excessive level detector may be configured for determining acoustic leakage in each of the ear canals based on the data on transfer functions.

The binaural excessive level detector may be configured for processing the determined transfer functions as explained above in order to determine acoustic leakage and control the ear canal audio signal processors of the first and second hearing devices to attenuate the respective processed ear canal audio signals in such a way that balanced occlusion cancellation in the two ears is obtained, wherein the obtained occlusion cancellation is the sum of reduction by acoustic leakage and active occlusion cancellation provided by subtracting the respective processed ear canal audio signal from the respective processed input transducer audio signal.

The binaural excessive level detector may be configured for modifying the amount required to keep signals of the first and second hearing devices within the dynamic range of the respective one of the first and second hearing devices, with respective values that are inversely proportional to the determined acoustic leakage in order to control the ear canal audio signal processors of the first and second hearing devices to provide balanced occlusion cancellation.

Thus, each of the first and second hearing devices of the binaural hearing device system may comprise an acoustic leakage detector for providing data on acoustic leakage, preferably at low frequencies, such as frequencies below 2 kHz, such as frequencies below 1 kHz, such as frequencies below 700 Hz, such as frequencies in the range between 100 Hz and 700 Hz, such as frequencies around 500 Hz, e.g., to the binaural excessive level detector.

Each of the acoustic leakage detectors may be configured for determination of a transfer function that involves the sound pressure in the ear canal space inside the fully or partly occluded ear canal, for example the transfer function from the output of the input transducer to the input of the output transducer and/or the transfer function of a feedback loop from the input of the output transducer to the output of the input transducer, and/or the transfer function from the input of the output transducer to the output of the ear canal microphone.

Preferably, for acoustic leakage detection, the acoustic leakage detectors are configured for determination of the same respective transfer function, or a same combination of respective transfer functions, of the respective first and second hearing devices with the same settings of the first and second hearing devices.

Preferably, each of the acoustic leakage detectors has an output for outputting data on the determined transfer functions to the binaural excessive level detector and the binaural excessive level detector is configured for processing the data on the determined transfer functions in order to determine possible acoustic leakage.

Reference values of the transfer functions of the first and second hearing devices utilized for acoustic leakage detection, may be determined, e.g. during fitting in a dispenser's office with the hearing devices properly mounted without acoustic leakage at the ears of the user, or during a sealed calibration performed at the factory, and the determined reference transfer functions may subsequently be used, e.g., by the binaural excessive level detector, for comparisons with the respective transfer functions determined later in order to detect possible acoustic leakage during normal use of the binaural hearing device system.

In one embodiment, the binaural excessive level detector is configured for determining a difference between the reference transfer functions and the respective transfer functions determined during normal use of the binaural hearing device system, and for modifying the control signals in accordance with the determined differences when the binaural excessive level detector has determined that the processed ear canal audio signals have to be attenuated to bring signals of the first and second hearing devices within the dynamic range of the first and second hearing devices.

For example, the binaural excessive level detector may be configured for modification of the control signals when the determined difference is larger than a predetermined or adjustable threshold at one or more predetermined frequencies when the binaural excessive level detector has determined that the processed ear canal audio signals have to be attenuated to bring signals of the first and second hearing devices within the dynamic range of the first and second hearing devices.

Utilization of reference transfer functions has the advantage that individual differences between the anatomy of the ears of the user and individual differences between the hearing devices worn at opposite ears of the user, are taken into account.

In presence of acoustic leakage, the binaural excessive level detector may be configured to output modified control signals to control the respective ear canal audio signal processors of the first and second hearing devices to attenuate the respective processed ear canal audio signals to be inversely proportional to the acoustic leakage at the frequencies at which the acoustic leakage is detected, in order to provide balanced occlusion cancellation in the two ears, wherein the obtained occlusion cancellation in each ear is the sum of reduction by acoustic leakage and the active occlusion cancellation provided by subtracting the respective processed ear canal audio signal from the respective processed input transducer audio signal.

For example, for a specific frequency range, such as a frequency range including 500 Hz, in the event that 1 dB acoustic leakage is detected for the first hearing device, i.e. the sound pressure of the ear canal is 1 dB lower than the sound pressure without acoustic leakage, and 8 dB acoustic leakage is detected for the second hearing device 10B, and the binaural excessive level detector has determined that the processed ear canal audio signal has to be attenuated by 10 dB in the first hearing device to bring the output transducer audio signal within the dynamic range of the output transducer, then the binaural excessive level detector 60A controls the ear canal audio signal processor to attenuate the processed ear canal audio signal 38A with the required 10 dB in the hearing device (since the detection is performed in presence of the 1 dB acoustic leakage), and the binaural excessive level detector 60B controls the ear canal audio signal processor of the second hearing device 10B to attenuate the processed ear canal audio signal with 10 dB minus the acoustic leakage difference in dB (8 dB−1 dB=7 dB), i.e. with 10 dB−7 dB=3 dB to obtain balanced occlusion cancellation in the two ears, wherein the obtained occlusion cancellation in each ear is the sum of reduction by acoustic leakage and the active occlusion cancellation provided by subtracting the respective processed ear canal audio signal from the respective processed input transducer audio signal.

The attenuation may be limited by the magnitude of the signal to be attenuated. For example, if the signal is 10 dB and the attenuation is 15 dB, the attenuation would result in amplification of the signal. This is not desired, and instead, the signal is attenuated to 0 dB resulting in a, typically brief, unbalanced occlusion cancellation.

In another embodiment, use of reference values of the transfer functions of the first and second hearing devices is avoided by assuming that the one of the first and second hearing devices with the highest level of the ear canal microphone audio signal at the frequencies at which acoustic leakage is detected, exhibits no acoustic leakage.

In this embodiment, the binaural excessive level detector may be configured for determining a difference between the transfer function, or combination of transfer functions, selected for acoustic leakage detection, of the first and second hearing devices, and for modifying the control signals in accordance with the determined differences when the binaural excessive level detector has determined that the processed ear canal audio signals have to be attenuated to bring signals of the first and second hearing devices within the dynamic range of the first and second hearing devices. For example, the binaural excessive level detector may be configured for modification of the control signals when a determined difference is larger than a predetermined or adjustable threshold at one or more predetermined frequencies.

The one of the first and second hearing devices with the highest level of the ear canal microphone audio signal at the frequencies at which acoustic leakage is detected, is the minuend so that the determined difference is larger than or equal to zero. Preferably, the acoustic leakage detectors are configured for determination of the same respective selected transfer function, or a same combination of respective selected transfer functions, of the respective first and second hearing devices with the same settings of the first and second hearing devices.

In presence of acoustic leakage, the binaural excessive level detector may be configured to output modified control signals to control the respective ear canal audio signal processors of the first and second hearing devices to attenuate the respective processed ear canal audio signals to be inversely proportional to the acoustic leakage at the frequencies at which the acoustic leakage is detected, in order to provide balanced occlusion cancellation in the two ears of the user, wherein the obtained occlusion cancellation in each ear is the sum of reduction by acoustic leakage and the active occlusion cancellation provided by subtracting the respective processed ear canal audio signal from the respective processed input transducer audio signal.

For example, for a specific frequency range, such as a frequency range including 500 Hz, in the event that the binaural excessive level detector has determined that the processed ear canal audio signal of the first hearing device has to be attenuated by 10 dB to bring the output transducer audio signal of the first hearing device within the dynamic range of the output transducer of the first hearing device, and that the binaural excessive level detector has determined a difference of 7 dB attributed to acoustic leakage of the second hearing device, then the binaural excessive level detector controls the ear canal audio signal processor of the first hearing device to attenuate the processed ear canal audio signal of the first hearing device with the required 10 dB, and the binaural excessive level detector controls the ear canal audio signal processor of the second hearing device to attenuate the processed ear canal audio signal of the second hearing device with 10 dB minus the acoustic leakage difference 7 dB=3 dB to obtain balanced occlusion cancellation in the two ears, wherein the obtained occlusion cancellation in each ear is the sum of reduction by acoustic leakage and the active occlusion cancellation provided by subtracting the respective processed ear canal audio signal from the respective processed input transducer audio signal.

The attenuation may be limited by the magnitude of the signal to be attenuated. For example, if the signal is 10 dB and the attenuation is 15 dB, the attenuation would result in amplification of the signal. Typically, this is not desired, and instead, the signal is attenuated to 0 dB resulting in a, typically brief, unbalanced occlusion cancellation.

Binaural Active Noise Cancellation (ANC)

In each of the first and second hearing devices, the hearing device may comprise an ANC circuit configured for active noise cancellation, e.g., similar to the ANC circuit disclosed in U.S. Pat. No. 6,445,799 B1, wherein an electro-acoustic system is disclosed that performs active noise cancellation at one ear of a user independently of possible noise cancellation performed at the other ear of the user; however, wherein the ANC circuit in each of the first and second hearing devices is additionally controlled by the control signals of the binaural excessive level detector. For example, a gain of the ear canal audio signal processor in each of the first and second hearing devices may be reduced, e.g. adaptively, by the same amount, e.g. in dB, in each of the first and second hearing devices in response to detection of excessive signal levels in one of the ears, or in both ears, by the binaural excessive level detector.

For example, at selected signal levels, the ANC circuit of first and second hearing devices may operate monaurally, i.e. independent of sound received at the other ear of the user. The binaural excessive level detector monitors signal levels in the first and second hearing devices and in the event that signal levels exceed a certain threshold, a gain of the ear canal audio signal processor of each of the first and second hearing devices is reduced, e.g. adaptively, by the same amount, e.g. in dB, e.g., the processed ear canal audio signals of the first and second hearing devices are attenuated by the same amount, e.g. in dB, in response to the control signals provided by the binaural excessive level detector.

In each of, or one of, the first and second hearing devices, the ANC circuit may be configured for reducing gain with the same amount, e.g. in dB, in a plurality of the frequency bands of the ear canal microphone audio signal in response to the control signals provided by the binaural excessive level detector.

In each of, or one of, the first and second hearing devices, the ANC circuit may be configured for reducing gain individually in a plurality of the frequency bands of the input transducer audio signal processor in response to the control signals provided by the binaural excessive level detector.

In each of, or one of, the first and second hearing devices, the ANC circuit may be configured for reducing gain as a function of broad-band power of the ear canal microphone audio signal in response to the control signals provided by the binaural excessive level detector.

In each of, or one of, the first and second hearing devices, signal processing parameters of the ANC circuit, such as the threshold of the binaural excessive level detector, etc., may be adjustable in accordance with user inputs.

Binaural Sound Environment Detector

The binaural hearing device system may also comprise a binaural sound environment detector for binaural determination of the sound environment surrounding a user of the binaural hearing device system based on at least one signal from the first hearing device and at least one signal from the second hearing device for provision of outputs for each of the first and second hearing devices for selection of signal processing parameter(s) of each of the respective hearing devices so that the first and second hearing devices of the binaural hearing device system perform coordinated signal processing.

The binaural sound environment detector may be configured for classifying the sound environment into a predetermined set of sound environment classes, such as speech, babble speech, restaurant clatter, music, traffic noise, etc.

Obtained classification results may be utilised in the first and second hearing devices to automatically select signal processing parameter(s) of the hearing device, e. g. to automatically switch to a most suitable signal processing algorithm for the environment in question.

Different signal processing algorithms available in the first and second hearing devices may change the signal characteristics significantly. Sound characteristics may however differ significantly at the two ears of a user, and individual determination of the sound environment at each ear of the user would thus differ, which could lead to undesired different signal processing of sounds for each of the ears of the user. This is avoided with the binaural sound environment detector that determines the sound environment binaurally, i.e. based on signals obtained at both ears of the user, whereby each of the first and second hearing devices processes sound in response to a common determination of sound environment so that the binaural hearing device system is able to provide optimum sound quality, e.g. speech intelligibility, to the binaural hearing device user in various sound environments.

Also, binaural sound environment detection is more accurate than monaural detection since signals from both ears are taken into account.

Binaural Hearing Devices

The binaural hearing device may comprise a data interface for transmission of data, possibly including digital audio, from one of the hearing devices to the other, and possibly to a wearable, e.g. a hand-held device.

The data interface may be a wired interface, e.g. a USB interface, or a wireless interface, such as a Bluetooth interface, e.g. a Bluetooth Low Energy interface.

The binaural hearing device may comprise an audio interface for reception of an audio signal from the wearable device.

The audio interface may be a wired interface or a wireless interface.

The data interface and the audio interface may be combined into a single interface, e.g. a USB interface, a Bluetooth interface, etc.

The binaural hearing device may for example have a Bluetooth Low Energy data interface for exchange of data between the binaural hearing device and the wearable device, and a wired audio interface for transmission of the audio signal.

The binaural hearing device may for example have a Bluetooth Low Energy data interface for exchange of data between the binaural hearing device and the wearable device, and a wired audio interface for transmission of the audio signal.

The binaural hearing device may for example have a Bluetooth Low Energy data interface for exchange of data and digital audio between the binaural hearing device and the wearable device. Such an interface is disclosed in EP 2 947 803 B1.

The binaural hearing device may comprise one or more external microphones for receiving external sound for user selectable transmission towards at least one of the ears of the user.

In the event that the binaural hearing device provides a sound proof, or substantially sound proof, transmission path for sound emitted by the output transducer(s) of the hearing device towards the ear(s) of the user, the user may be acoustically disconnected in an undesirable way from the surroundings. This may for example be dangerous when moving in traffic.

The binaural hearing device may have a user interface, e.g. a push button, so that the user can switch the microphone on and off as desired thereby connecting or disconnecting the external microphone of the binaural hearing device.

The binaural hearing device may have a mixer with an input connected to an output of the one or more external microphones and another input connected to another source of an audio signal, e.g. the wearable device, e.g. the hand-held device, supplying an audio signal, and an output providing an audio signal that is a weighted combination of the two input audio signals.

The user input may further include means for user adjustment of the weights of the combination of the two input audio signals, such as a dial, or a push button for incremental adjustment.

The binaural hearing device may have a threshold detector for determining the loudness of the external signal received by the external microphone, and the mixer may be configured for including the output of the external microphone signal in its output signal only when a certain threshold is exceeded by the loudness of the external signal.

Further ways of controlling audio signals from an external microphone and a voice microphone is disclosed in US 2011/0206217 A1.

Binaural Hearing Aid

The binaural hearing device may be a binaural hearing aid, wherein each of the first and second hearing devices is a hearing aid, such as a BTE, RIE, ITE, ITC, or CIC, etc., hearing aid, comprising a hearing loss processor that is configured to process the audio signal in accordance with a predetermined signal processing algorithm to generate a hearing loss compensated audio signal compensating a hearing loss of a user.

The hearing loss processor may comprise a dynamic range compressor configured for compensating the hearing loss including loss of dynamic range.

The hearing loss processor may form part of the transducer audio signal processor.

Hearing impaired persons are, compared to persons with normal hearing, more susceptible to discomfort when subjected to sound occlusion of high sound pressure levels.

A dynamic range compressor, in short "a compressor", in a hearing aid, utilizes dynamic sound level compression with time constants that are sufficiently long to avoid distortion of temporal characteristics of speech. The associated recruitment effect alleviated with a hearing aid increases the discomfort caused by sound occlusion with high energy.

Typically, a hearing impaired user suffering from sensorineural hearing loss experiences a loss of hearing sensitivity that is 1) frequency dependent and 2) dependent upon the loudness of sound at an ear.

Thus, a hearing impaired user may be able to hear certain frequencies, e.g., low frequencies, as well as a user with normal hearing, while other frequencies are not heard as well. Typically, hearing impaired users experience loss of hearing sensitivity at high frequencies.

At frequencies with reduced sensitivity, the hearing impaired user is often able to hear loud sounds as well as the user with normal hearing, but unable to hear soft sounds with the same sensitivity as the user with normal hearing. Thus, the hearing impaired user suffers from a loss of dynamic range.

A dynamic range compressor in a hearing aid compresses the dynamic range of sound arriving at an ear of the hearing impaired user to match the residual dynamic range of the user in question. The degree of dynamic hearing loss of the hearing impaired user may be different in different frequency bands.

The slope of the input-output compressor transfer function is referred to as the compression ratio. The compression ratio required by a user may not be constant over the entire input power range, i.e. typically the compressor characteristic has one or more knee-points.

Thus, dynamic range compressors may be configured to perform differently in different frequency bands, thereby accounting for the frequency dependence of the hearing loss of the user in question. Such a multiband or multichannel compressor divides an input signal into two or more frequency bands or frequency bands and then compresses each frequency band or channel separately.

The multiband or multichannel compressor may divide the input signal into two or more warped frequency bands or frequency bands.

The dynamic range compressors further have attack and release time constants. The attack time constant determines the time it takes for the compressor to react at the onset of a loud sound. That is, the time it takes to turn down the gain. The release time constant determines the time it takes for the system to turn up the gain again after the loud sound has terminated. Most often the attack time is quite short (<5 milliseconds) with the release time being longer (anywhere from 15 to hundreds of milliseconds).

The parameters of the compressor, such as compression ratio, positions of knee-points, attack time constant, release time constant, etc. may be different for each frequency band.

Dynamic range compressors are fitted to the hearing loss of the user by adjustment of compressor parameters in accordance with accepted fitting rules and based on hearing thresholds determined for the user.

EP 1 448 022 A discloses a hearing aid with a multiband compressor.

In each of, or one of, the first and second hearing devices, an AOC circuit may be configured for performing signal processing parameter adjustments, e.g. gain adjustment, attack time adjustment, release time adjustment, etc., based on gain settings of the hearing loss processor and/or the compressor.

In each of, or one of, the first and second hearing devices, an ANC circuit may be configured for performing signal processing parameter adjustments, e.g. gain adjustment, attack time adjustment, release time adjustment, etc., based on gain settings of the hearing loss processor and/or the compressor.

Headset, Headphone, Etc.

The binaural hearing device may be a headset, headphone, earphone, ear defender, or earmuff, etc., such as an Ear-Hook, In-Ear, On-Ear, Over-the-Ear, Behind-the-Neck, Helmet, or Headguard, etc.

The binaural hearing device may be a headset or a headphone having a headband carrying two earphones. The headband is intended to be positioned over the top of the head of the user as is well-known from conventional headsets and headphones.

The transducer audio signal processor, or one or more parts of the transducer audio signal processor, of the binaural hearing device system may be accommodated in the headband of the binaural hearing device. For example, the binaural excessive level detector may be accommodated in the headband of the binaural hearing device.

The binaural hearing device may have a neckband carrying two earphones. The neckband is intended to be positioned behind the neck of the user as is well-known from conventional neckband headsets and headphones.

The transducer audio signal processor, or one or more parts of the transducer audio signal processor, of the binaural hearing device system may be accommodated in the neckband of the binaural hearing device. For example, the binaural excessive level detector may be accommodated in the neckband of the binaural hearing device.

Wearable Device

The binaural hearing device system may comprise a device separate from the binaural hearing device, such as a wearable device, such as a smartwatch, an activity tracker, a hand-held device, such as a remote control for the binaural hearing device, a hand-held computer, such as a smartphone, a tablet computer, a PDA, etc., and configured to communicate with other parts of the binaural hearing device through a wired interface and/or through a wireless interface.

The transducer audio signal processor, or one or more parts of the transducer audio signal processor, of the binaural hearing device system may be accommodated in the wearable device. For example, the binaural excessive level detector and/or the binaural sound environment detector may be accommodated in the wearable device.

The wearable device may comprise a data interface for reception and transmission of data to and from the binaural hearing device.

The data interface may be a wired interface, e.g. a USB interface, or a wireless interface, such as a Bluetooth interface, e.g. a Bluetooth Low Energy interface.

The wearable device may comprise an audio interface for transmission, and optional reception, of an audio signal to, and optionally from, the binaural hearing device.

The audio interface may be a wired interface or a wireless interface.

For example, the hearing devices of the binaural hearing device may be connected to the wearable device with a cord providing a wired audio interface for transmission of speech and music from the wearable device to the hearing devices of the binaural hearing device.

The data interface and the audio interface may be combined into a single interface, e.g. a USB interface, a Bluetooth interface, etc.

The wearable device may for example have a Bluetooth Low Energy data interface for reception of the determined signal level of the first hearing device and the determined signal level of the second hearing device and for transmission of the control signals for each of the first and second hearing devices for control of the respective ear canal audio signal processor to attenuate each of the processed ear canal audio signals with the same amount, e.g. in dB, in such a way that both of the determined signal levels are lowered so that audio signals of the first and second hearing devices are kept within the dynamic range of the first and second hearing devices.

The user may use a user interface of the wearable device to control the binaural hearing device, e.g. for selection of a specific signal processing algorithm, or for adjustment of a signal processing parameter, such as the volume, the threshold of the binaural excessive level detector, etc.

BRIEF DESCRIPTION OF THE DRAWINGS

Other and further aspects and features will be evident from reading the following description of the embodiments.

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

In the drawings:

Figure 1:
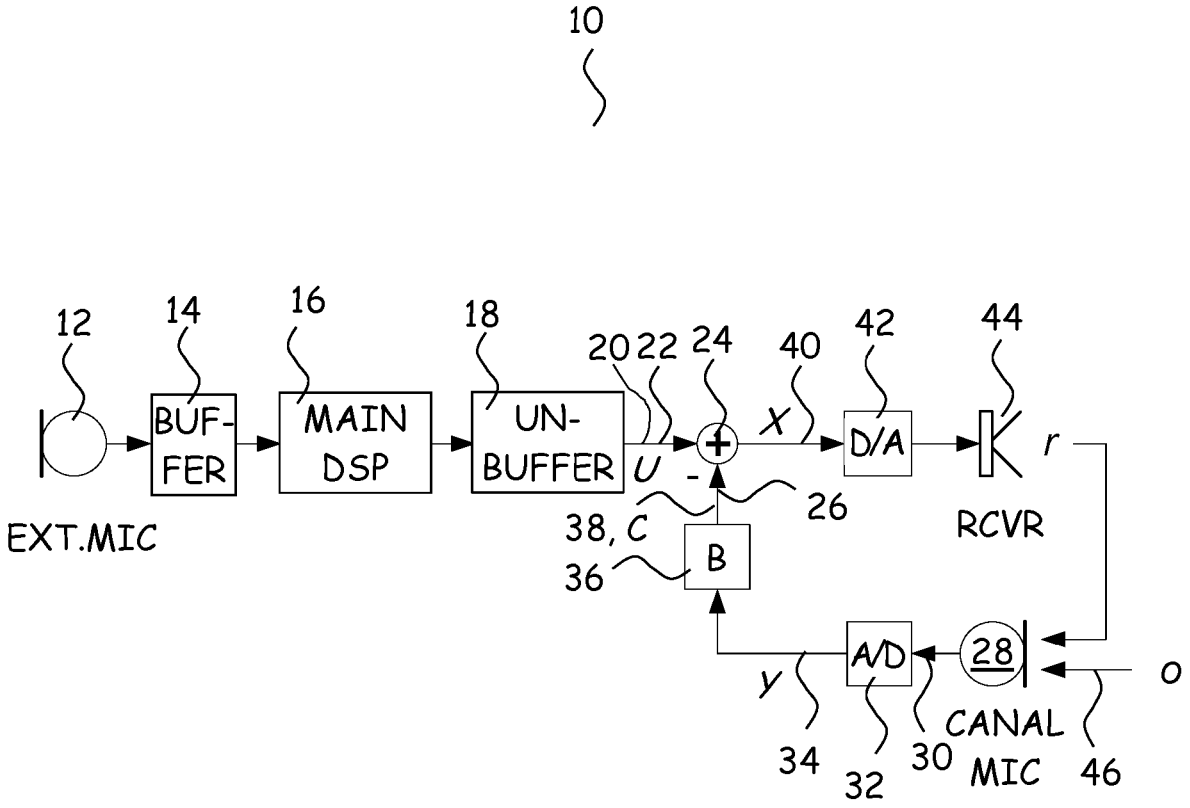
(Prior art) Fig. 1
Figure 2:
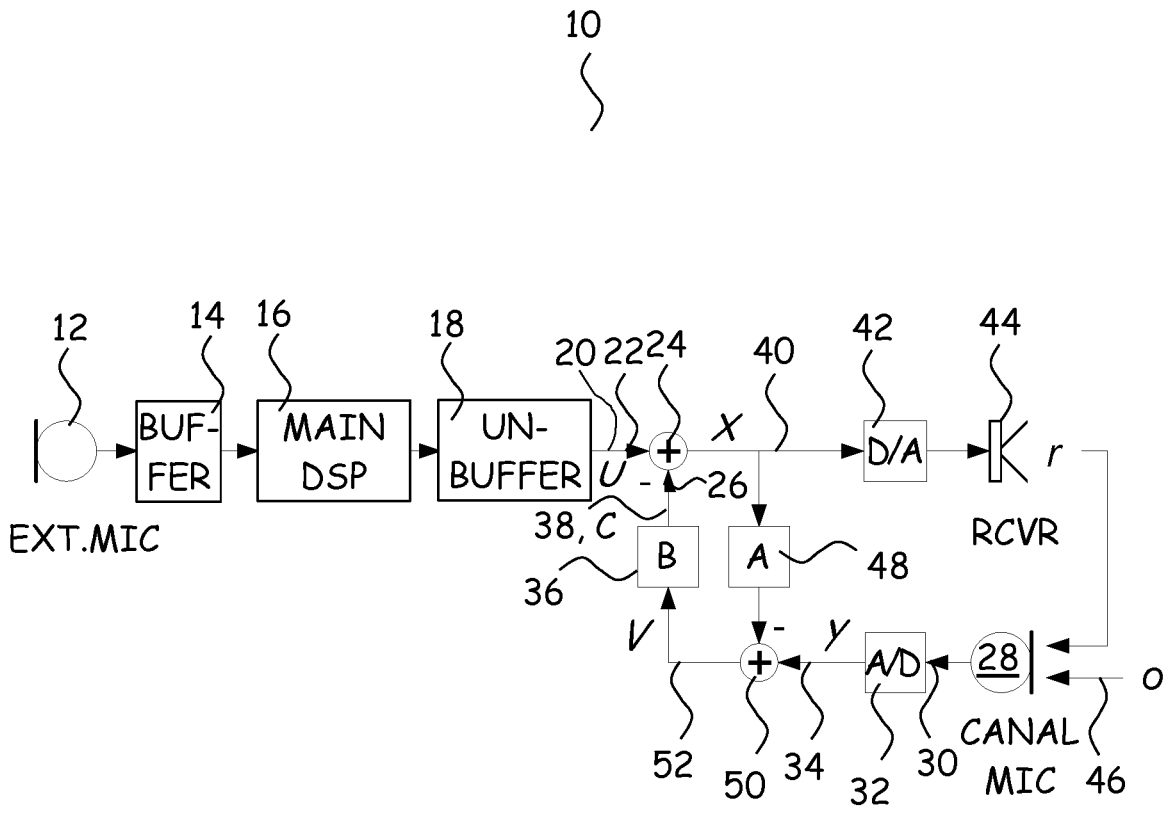
(Prior art) Fig. 2
Figure 3:
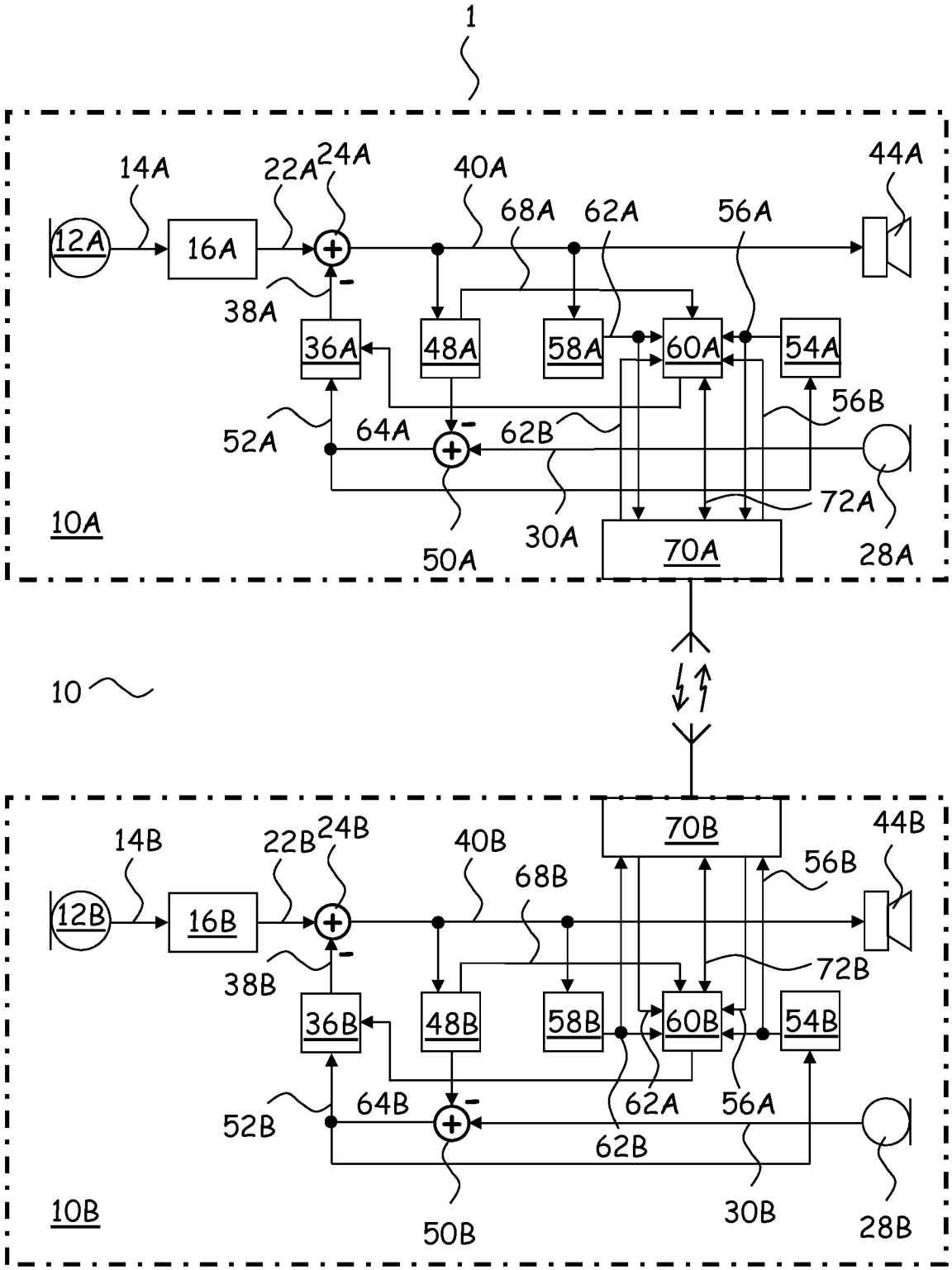
Figure 4:
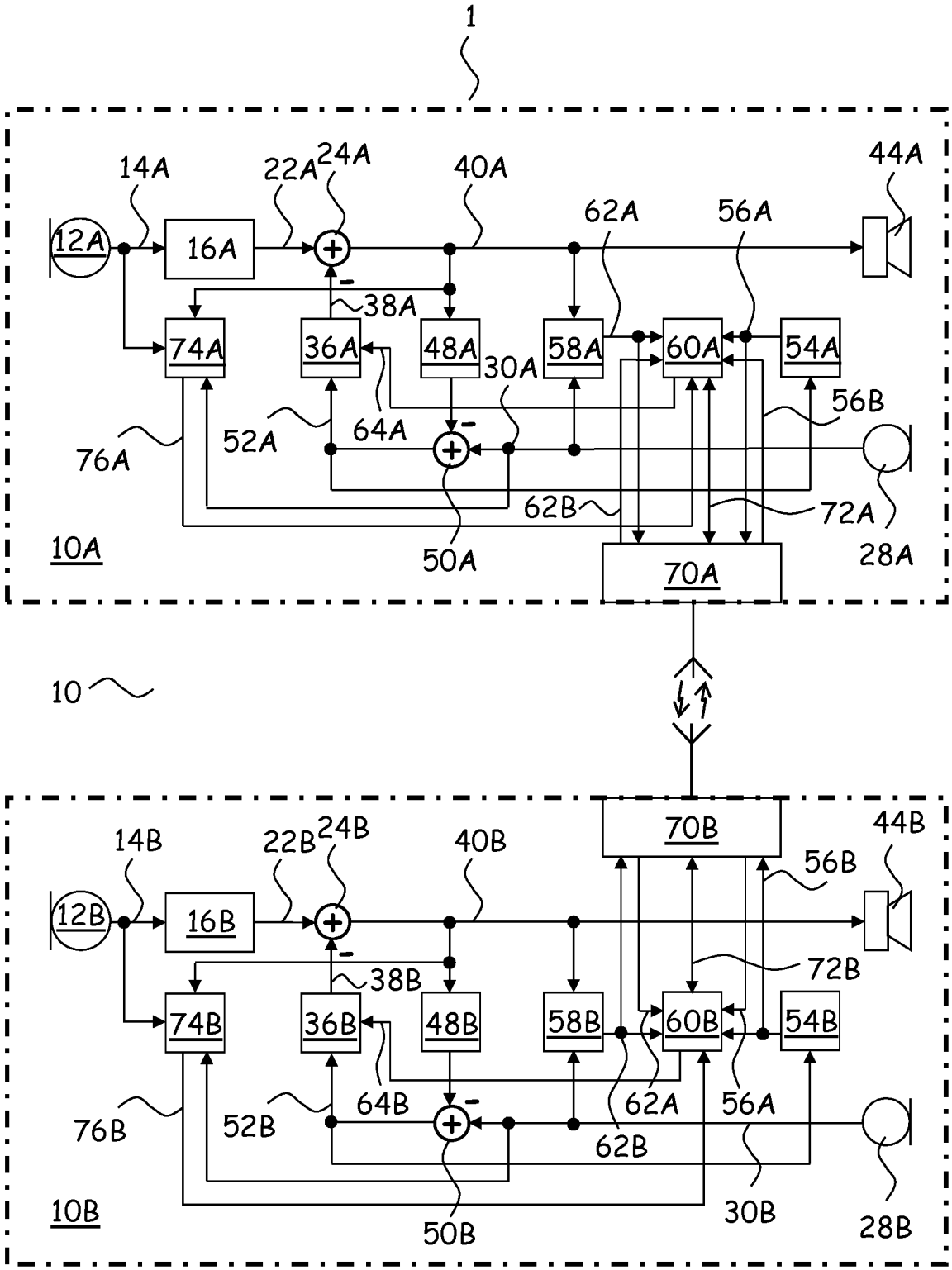
Figure 5:
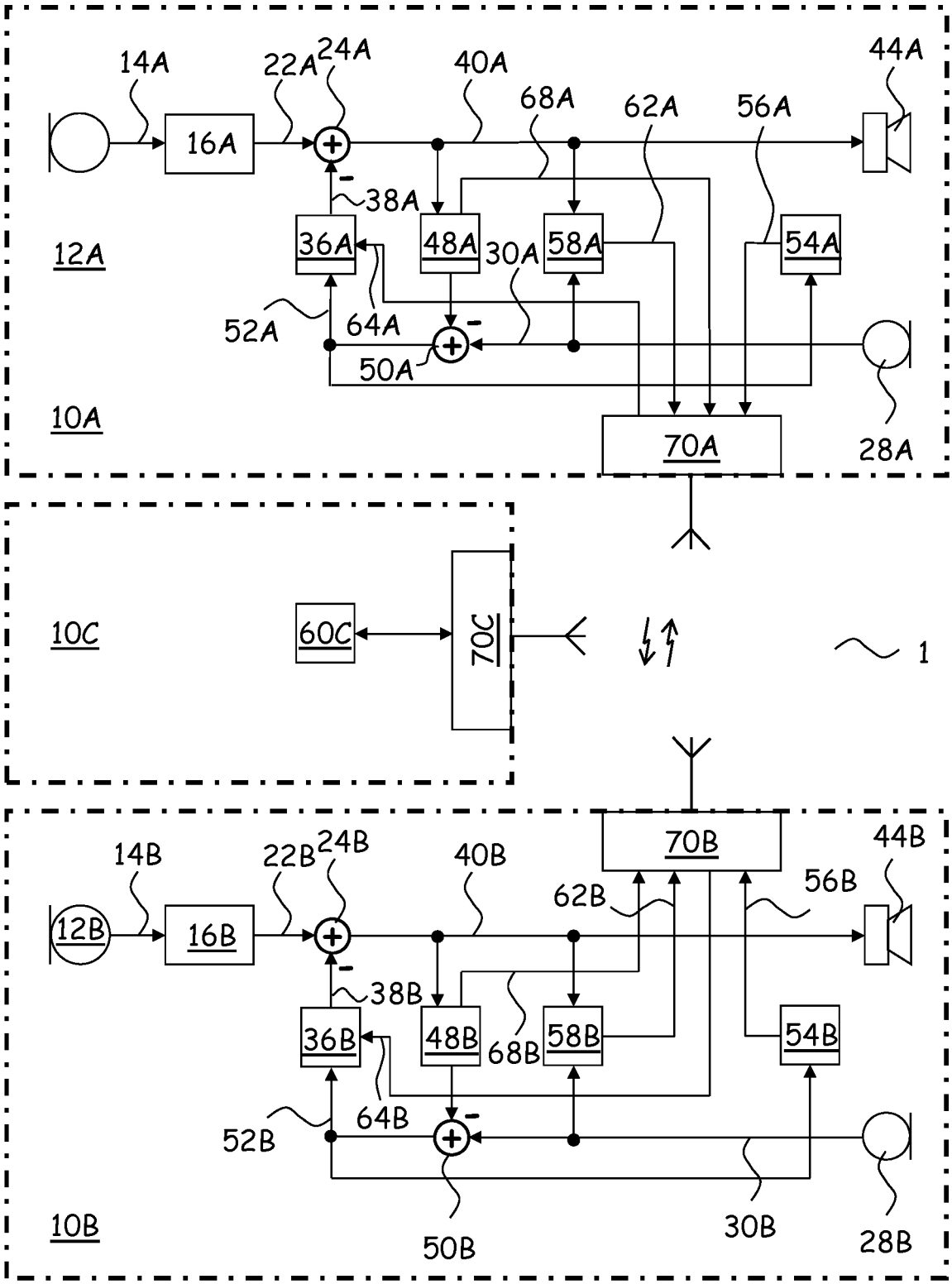
Figure 6:
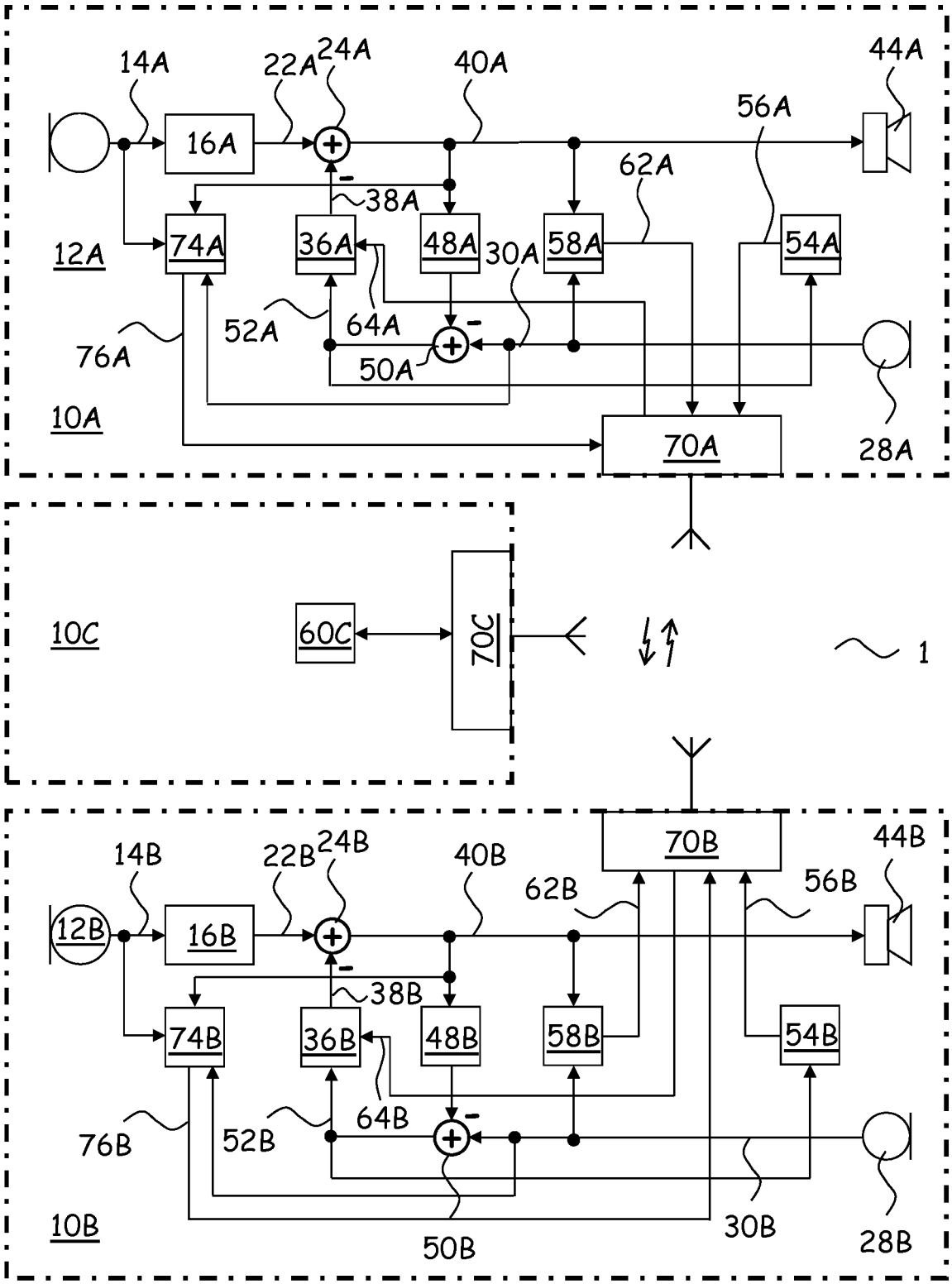

FIG. 1 shows a block diagram of a known active occlusion cancellation circuit, FIG. 2 shows a block diagram of another known active occlusion cancellation circuit, FIG. 3 shows a block diagram of a binaural hearing device system with a new binaural active occlusion cancellation circuit, FIG. 4 shows a block diagram of another binaural hearing device system with a new binaural active occlusion cancellation circuit, FIG. 5 shows a block diagram of yet another binaural hearing device system with the new binaural active occlusion cancellation circuit, and FIG. 6 shows a block diagram of still yet another binaural hearing device system with the new binaural active occlusion cancellation circuit.

DETAILED DESCRIPTION OF THE DRAWINGS

Various illustrative examples of the novel hearing device according to the appended claims will now be described more fully hereinafter with reference to the accompanying drawings, in which various embodiments of novel hearing device are illustrated. The novel hearing device according to the appended claims may, however, be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other examples even if not so illustrated, or if not so explicitly described. It should also be noted that the accompanying drawings are schematic and simplified for clarity, and they merely show details which are essential to the understanding of the novel hearing device, while other details have been left out.

As used herein, the singular forms "a," "an," and "the" refer to one or more than one, unless the context clearly dictates otherwise.

FIG. 1 shows a block diagram of a known hearing device circuit 10 with an active occlusion cancellation circuit.

The hearing device has a microphone 12 for provision of an input transducer audio signal in response to external sound received at the microphone 12. The input transducer audio signal is sampled and digitized in an A/D converter (not shown) and the buffer 14 groups the samples into blocks of samples for input to the transducer audio signal processor 16.

The transducer audio signal processor 16 is adapted to process the sample blocks in accordance with a predetermined signal processing algorithm to generate processed blocks of samples, each of which is divided into a sequence of single samples in the unbuffer circuit 18 forming the processed input transducer audio signal 20.

The processed input transducer audio signal 20 is input to a first input 22 of a signal combiner 24. A signal input at a second input 26 of the signal combiner 24 is subtracted from the processed input transducer audio signal 20 to reduce the occlusion effect by subtracting a signal that cancels undesired low frequency sound in the user's ear canal generated by low frequency amplification of body conducted sound, for example originating from the user's own voice, jaw motion, body impact, e.g, caused by walking, running, falling, etc. The body conducted sound is picked up by an ear canal microphone 28 that is accommodated in a housing (not shown) that is adapted to be positioned in an ear canal of the user whereby the ear canal microphone 28 is positioned to sense the ear canal sound pressure in the ear canal space inside the fully or partly occluded ear canal between a distal portion of the housing (not shown) and the ear drum (not shown). The ear canal sound pressure detected by the ear canal microphone 28 is a superposition of body conducted sound and output transducer emitted sound. The ear canal microphone 28 is adapted for provision of an ear canal microphone audio signal 30 in response to the ear canal sound pressure. The ear canal microphone audio signal 30 is sampled and digitized in an A/D converter 32 and the samples 34 are forwarded sequentially to the filter 36 that inputs a filtered ear canal audio signal 38 suitable for suppression of the occlusion effect at the second input 26 of the signal combiner 24, whereby the user perceives only the processed input transducer audio signal 20, without perception of body conducted sound.

The signal combiner 24 provides an output transducer audio signal 40 that is equal to the processed input transducer audio signal 20 received at the first input 22 minus the signal 38 received at the second input 26 of the signal combiner 24 to a D/A converter 42 for conversion of the digital output transducer audio signal into an analogue signal that is converted in an output transducer 44 to an acoustic signal for emission towards the eardrum of the user.

When x is the output transducer audio signal 40, u is the processed input transducer audio signal 20, o is the occlusion signal 46 that is desirably cancelled, y is the ear canal microphone audio signal 34, B is the transfer function of the filter 36, R is the transfer function from the input of the output transducer 44 to the output of the ear canal microphone 28 (y/x); then, slightly simplified, the output transducer audio signal x is given by:

$$x = \frac{u - Bt}{1 + BR} \tag{1}$$

and the ear canal microphone audio signal y is given by:

$$y = \frac{Ru + t}{1 + BR} \tag{2}$$

wherein the transfer function from the output transducer 44 to the output of the ear canal microphone 28 has been simplified to $$y=Rx+t$$

ignoring possible non-linarites and attributing all signal delays to the output transducer 44.

In the known active occlusion cancellation circuit 24, 28, 32, 36 shown in FIG. 1, it is not possible to distinguish between desired and undesired signals. As a consequence the main signal path of the circuit of FIG. 1 from the processed input transducer audio signal 20 to the output of the output transducer 44 requires additional amplification to obtain the same output signal as without the active occlusion cancellation circuit, i.e. the processed input transducer audio signal 20 has to be multiplied with [1+BR] for equalization, i.e. to compensate for the active occlusion cancellation circuit. This may lead to reduced dynamic range, e.g., by saturation at the output transducer for lower magnitudes of the compensated transducer audio signal 20 and/or an increase in the noise floor.

FIG. 2 shows a block diagram of a known hearing device circuit 10 with another active occlusion cancellation circuit.

Further active occlusion cancellation circuits are shown in co-pending European Patent Application No.: 16206073.5.

The circuit 10 of FIG. 2 is identical to the circuit 10 of FIG. 1 apart from the fact that in the circuit of FIG. 2 a second filter 48 and a second signal combiner 50 have been added to the circuit 10 of FIG. 1. In FIG. 2, the first filter 36 and the first signal combiner 24 correspond to the filter 36 and the signal combiner 24, respectively, of FIG. 1.

The second filter 48 models the transfer function of the signal path from the input of the output transducer 44 to the output of the ear canal microphone 28 (y/x) to distinguish the desired signal, namely the processed input transducer audio signal 20, from the undesired signal, namely the occlusion signal 46. Like the first filter 36, the second filter 48 operates sample based with very low delay.

In the active occlusion cancellation circuit of FIG. 2, the equations (1) and (2) of the active occlusion cancellation circuit of FIG. 1 turn into:

$$x=\frac{u-Bt}{1+B(R-A)} \tag{3}$$

$$y=\frac{Ru+(1-AB)t}{1+B(R-A)} \tag{4}$$

Thus, in order to minimize the effect of the active occlusion cancellation circuit on the desired output signal of the output transducer 44, the transfer function A of the second filter 48 should match the transfer function R (y/x) from the input of the output transducer 44 to the output of the ear canal microphone 28, and |1−AB| should be minimized, e.g. in a desired frequency range, e.g, utilizing least mean squares minimization techniques.

As indicated by the denominator of equations (3) and (4), the circuit 10 of FIG. 2 may become unstable with changes in R, for example outside the ear, which makes insertion of the housing (not shown) with the output transducer 44 into the ear canal of the user rather uncomfortable. Also, the first and second filters 36, 48 may have to implement rather long impulse responses requiring many filter taps because the effective implementation is non-recursive, and which is not desirable since both filters operate sample-based at a high rate for low delay.

FIG. 3 is a block diagram of a binaural hearing device system 1 falling under the terms of claim 1.

The binaural hearing device system 1 of FIG. 3 is a binaural hearing aid system with active occlusion cancellation; however, it should be understood that another hearing device system falling under the terms of claim 1 and operating in accordance with claim 12 may not include hearing loss compensation and may not include active occlusion cancellation, for example another hearing device system falling under the terms of claim 1 and operating in accordance with claim 12 may include active noise cancellation and/or feedback cancellation.

The illustrated binaural hearing device system 1 is a binaural hearing aid system 1. The illustrated binaural hearing device system 1 comprises a first hearing device 10A that is configured to provide compensation of hearing loss of the left ear of a user wearing the binaural hearing device system 1, and a second hearing device 10B that is configured to provide compensation of hearing loss of the right ear of the user.

Each of the illustrated first hearing device 10A and second hearing device 10B comprises an input transducer comprising a set of external microphones 12A, 12B consisting of one external microphone 12A, 12B for provision of the input transducer audio signal in response to external sound and positioned outside the ear canal of the user wearing the binaural hearing device system 1; and an A/D converter (not shown) for provision of a digital transducer audio signal 14A, 14B in response to sound signals received at the external microphone 12A, 12B in a sound environment, a transducer audio signal processor 16A, 16B that is configured to process the digital transducer audio signals 14A, 14B in accordance with a predetermined signal processing algorithm to generate a hearing loss compensated audio signal 22A, 22B provided as a first input 22A, 22B to the first signal combiner 24A, 24B, and a D/A converter (not shown) and an output transducer 44A, 44B (also denoted a receiver in accordance with hearing aid terminology) for conversion of output 40A, 40B of the first signal combiner 24A, 24B to an acoustic output signal for emission towards the left and right ear drums, respectively, of the user wearing the binaural hearing device system 1.

For simplicity, the operation of the binaural hearing device system 1 is explained for a system 1 wherein each of the illustrated first hearing device 10A and second hearing device 10B further comprises an AOC circuit similar to the prior art AOC circuit shown in FIG. 2. However, it should be noted that the AOC circuit may be substituted by any of the AOC circuits disclosed in co-pending European Patent Application No.: 16206073.5 or another known AOC circuit.

Each of the AOC circuits has an ear canal microphone 28A, 28B for provision of the ear canal microphone audio signal 30A, 30B in response to sound inside the ear canal of the user wearing the binaural hearing device system 1; first signal combiner 24A, 24B; second signal combiner 50A, 50B; first filters 48A, 48B and an ear canal audio signal processor 36A, 36B, namely second filters 36A, 36B, for processing the ear canal audio signal 52A, 52B into a processed ear canal audio signal 38A, 38B, and wherein the AOC circuit operates as explained above with reference to FIGS. 1 and 2. In order to cancel occlusion, each of the illustrated first hearing device 10A and second hearing device 10B comprises the first combiner 24A, 24B configured for subtracting the processed ear canal audio signal 38A, 38B from the processed input transducer audio signal 22A, 22B, namely the hearing loss compensated audio signal, to produce the output transducer audio signal 40A, 40B.

However, the prior art AOC circuit may cause distortion if the sound in the ear canal originating from the user body that it is desired to cancel has high amplitude. The resulting cancellation signal, i.e. the processed ear canal audio signal, may have even higher amplitude, and may cause distortion if the nominal dynamic range of the AOC circuit is exceeded, e.g. if the nominal dynamic range of the output transducer 44 and/or an amplifier is exceeded.

Further, operation of the AOC circuit increases the noise level. This will especially be audible for users with normal hearing or mild hearing loss, and will be even more audible in quiet, e.g. using hearing protection.

In the binaural hearing device system shown in FIG. 3, the prior art AOC circuit has been modified to suppress distortion and noise and binaural artefacts.

Binaural artefacts caused by known AOC circuits include user perception of noise moving from one ear to the other, that the own voice sounds differently in the two ears, and other bothering effects.

Excessive level is the situation wherein the operation of at least one of the AOC circuits of the first and second hearing devices 10A, 10B drives one or more components of the first and second hearing devices 10A, 10B, e.g. the output transducer, an amplifier, etc., outside its nominal dynamic range.

Each of the illustrated first and second hearing devices 10A, 10B further comprises a signal level detector 58A, 58B connected to the output transducer audio signal 40A, 40B including the hearing loss compensated signal 22A, 22B, or the ear canal microphone audio signal 30A, 30B, or both; and configured for determining a signal level of the output transducer audio signal 40A, 40B, or the ear canal microphone audio signal 30A, 30B, or both.

The first hearing device 10A comprises a first part 60A of the binaural excessive level detector 60A, 60B and the second hearing device 10B comprises a second part 60B of the binaural excessive level detector 60A, 60B, wherein the first part 60A of the binaural excessive level detector 60A, 60B is connected to the signal level detector 58A of the first hearing device 10A and the signal level detector 58B of the second hearing device 10B for reception of the output signals 62A, 62B with the determined signal levels, and configured for outputting the first control signal 64A to the ear canal audio signal processor 36A of the first hearing device 10A in response to the determined signal levels, and wherein the second part 60B of the binaural excessive level detector 60A, 60B is connected to the signal level detector 58A of the first hearing device 10A and the signal level detector 58B of the second hearing device 10B for reception of the output signals 62A, 62B with the determined signal levels, and configured for outputting the second control signal 64B to the ear canal audio signal processor 36B of the second hearing device 10B in response to the determined signal levels.

In the illustrated first and second hearing devices 10A, 10B, the first part 60A and second part 60B of the binaural excessive level detector detect excessive level by comparison of each of the output signals 62A, 62B of the signal level detectors 58A, 58B with a predetermined threshold.

In the illustrated example of FIG. 3, when at least one of the output signals 62A, 62B with the determined signal level exceeds the predetermined threshold, each of the control signals 64A, 64B controls the respective ear canal audio signal processor 36A, 36B, namely second filters 36A, 36B, to attenuate the respective processed ear canal audio signal 38A, 38B so that the dynamic range of the first and second hearing devices 10A, 10B is no longer exceeded.

Each of the output signals 62A, 62B with the determined signal level, is forwarded to the respective one of the first part 60A and second part 60B of the binaural excessive level detector of the other hearing device 10B, 10A via the wireless transceivers 70A, 70B, and each of the first part 60A and second part 60B of the binaural excessive level detector determines the amount, e.g. in dB, needed to bring signal levels of audio signals of the first and second hearing devices 10A, 10B within the dynamic range of the first and second hearing devices 10A, 10B. Both control signals 64A, 64B then control the respective ear canal audio signal processor 36A, 36B to attenuate the processed ear canal audio signals 38A, 38B with the determined same amount, e.g. in dB, so that symmetric binaural attenuation of the processed ear canal audio signals 38A, 38B is performed (unless one of the processed ear canal audio signals 38A, 38B has a low magnitude and is attenuated to zero in which case symmetric attenuation cannot be obtained).

Thus, the output transducer audio signals 40A, 40B are attenuated by the same amount, e.g. in dB, namely the value required to attenuate the output transducer audio signal 40A, 40B with the largest determined sound level within the dynamic range of the first and second hearing devices 10A, 10B, whereby binaural artefacts, such as user perception of noise moving from one ear to the other, user perception that the own voice sounds differently in the two ears, and other bothering effects.

With the binaural excessive level detector 60A, 60B, it is possible to distinguish between one-sided occurrences of excessive level, i.e. excessive level occurring at one of the ears of the user wearing the binaural hearing device system 1, but not at the other ear of the user, e.g. caused by wind noise, user button operations, scratching helmet, etc., and two-sided excessive level, wherein excessive level occurs binaurally, i.e. simultaneously at both ears of the user.

In the binaural hearing device system shown in FIG. 3, each of the illustrated first and second hearing devices 10A, 10B includes a body conducted sound detector 54A, 54B of the at least one body conducted sound detector, each of which is configured for detection of body conducted sound in the respective ear canal of the user of the binaural hearing device system 1. Body conducted sound is sound originating from the user's own body, for example originating from the user's own voice, jaw motion, body impact, e.g. caused by walking, running, falling, etc.

In the binaural hearing device system shown in FIG. 3, each of the body conducted sound detectors 54A, 54B, utilizes that separation of body conducted sound from external sound is performed by second filter 48A, 48B and second signal combiner 50A, 50B. The second filter 48A, 48B models the transfer function from the input of the output transducer 44A, 44B to the output of the ear canal microphone 28A, 28B so that the output signal provided by the second filter 48A, 48B corresponds to the part of the ear canal microphone audio signal 30A, 30B originating from the output transducer 44A, 44B. This part is subtracted from the ear canal microphone audio signal 30A, 30B by the second signal combiner 50A, 50B thereby providing the part 52A, 52B of the ear canal microphone audio signal 30A, 30B, denoted the ear canal audio signal 52A, 52B; corresponding to the body conducted sound of the respective ear canal. The ear canal audio signal 52A, 52B is input to the body conducted sound detector 54A, 54B for detection of body conducted sound when present.

In the binaural hearing device system shown in FIG. 3, each of the body conducted sound detectors 54A, 54B provides output signals 56A, 56B to each of the first part 60A and second part 60B of the binaural excessive level detectors 60A, 60B of the first and second hearing devices 10A, 10B providing information to the binaural excessive level detector 60A, 60B on whether body conducted sound is detected in both ears of the user wearing the binaural hearing device system 1, and possibly the type of body conducted sound detected, such as the user's own voice, sound caused by jaw movement, impact sound, etc., e.g. each type distinguished by characteristic spectral content.

In the binaural hearing device system shown in FIG. 3, each of the first part 60A and second part 60B of the binaural excessive level detector of the first and second hearing devices 10A, 10B is configured so that the control signals 64A, 64B disables operation of the respective AOC circuit of the first and second hearing devices 10A, 10B, e.g. by setting the respective processed ear canal audio signal 38A, 38B to zero, when no body conducted sound is detected in any of the ear canals of the user wearing the binaural hearing device system 1. This function is optional and may not be present in other binaural hearing device systems according to the appended claims.

In this way, it is possible to distinguish between one-sided occurrences of body conducted sound, i.e. body conducted sound occurring at one of the ears of the user, but not at the other ear of the user, e.g. caused by wind noise, user button operations, scratching helmet, etc., and two-sided, binaural body conducted sound caused by, e.g., the user's own voice, jaw movement, body impact with another object, etc., that in the binaural hearing device system shown in FIG. 3, leads to enablement of active occlusion cancellation in both the first and second hearing devices 10A, 10B.

Disabling operation of the AOC circuit lowers noise, since the noise contribution from the AOC circuit is eliminated.

In the illustrated binaural hearing device system 1 shown in FIG. 3, each of the illustrated first and second hearing devices 10A, 10B comprises a transducer audio signal processor 16A, 16B configured for compensation of the hearing loss of a user wearing the hearing device system 1. As is well known in the art of hearing devices, the processing of the transducer audio signal processors 16A, 16B are typically controlled by various selectable signal processing algorithms each of which having various parameters for adjustment of the actual signal processing performed, such as the various parameters of a dynamic range compressor performing hearing loss compensation as is well known in the art of hearing aids, and forming part of each of the transducer audio signal processors 16A, 16B shown in FIG. 3.

In the illustrated binaural hearing device system 1 shown in FIG. 3, the inputs of each of the first filters 48A, 48B are connected to the output transducer audio signal 40A, 40B; however the inputs may instead be connected to the respective hearing loss compensated signal 22A, 22B as explained in more detail in co-pending European Patent Application No.: 16206073.5.

In the illustrated hearing device system 1 shown in FIG. 3, each of the circuits 24A, 28A, 36A, 48A, 50A, 54A, 58A, 60A; 24B, 28B, 36B, 48B, 50B, 54B, 58B, 60B; and each of the respective transducer audio signal processor 16A, 16B of the first and second hearing devices 10A, 10B forms part of one respective common signal processor of the respective one of the first and second hearing devices 10A, 10B.

In another binaural hearing device system (not shown), the signal processing of both the first and second hearing devices 10A, 10B is performed by one common signal processor, for example located in a housing of one of the first and second hearing devices 10A, 10B or in another housing of the binaural hearing device system, such as in a housing of a wearable device, such as a smartwatch, an activity tracker, a hand-held device, such as a smartphone, a remote control, etc., etc., forming part of the binaural hearing device system.

In yet other binaural hearing device systems (not shown), the signal processing is performed by a plurality of signal processors, each of which, or parts of which, may be located in a housing of one of the first and second hearing devices 10A, 10B or in another housing of the binaural hearing device system, such as in another device, such as a wearable device, such as a smartwatch, an activity tracker, a hand-held device, such as a smartphone, a remote control, etc., etc., forming part of the binaural hearing device system.

In the binaural hearing device system shown in FIG. 3, the first and second hearing devices 10A, 10B are interconnected in a Bluetooth LE wireless network for transmission of the control signals 56A, 56B, 62A, 62B between the first and second hearing devices 10A, 10B.

As disclosed in US 2010/0220881 A1, occlusion may be caused by impact sound in the ear canal, e.g, generated by walking, running, or other types of body impact with another object, etc.

The body conducted sound detectors 54A, 54B may include a binaural impact sound detector as disclosed in US 2010/0220881 A1 that is configured for detection of impact sound and may provide the control signals 56A, 56B in response to the detection of impact sound.

Each of the body conducted sound detectors 54A, 54B may comprise an acceleration sensor and/or a vibration sensor in each of the illustrated first and second hearing devices 10A, 10B for detection of body conducted sound.

Each of the binaural impact sound detectors 54A, 54B may comprise an acceleration sensor and/or a vibration sensor in each of the illustrated first and second hearing devices 10A, 10B, e.g. utilized for detection of human walking.

The closure of the ear canal causing the occlusion effect may not be equally tight in both ears of the user wearing the binaural hearing device system 1, and thus may cause unequal acoustic leakage in the ear canals. In the binaural hearing device system 1 shown in FIG. 3, the signal level reduction controlled by the binaural excessive level detector 60A, 60B at each ear of the user is inversely proportional to the acoustic leakage in order to provide balanced occlusion cancellation in the two ears.

In the binaural hearing device system 1 shown in FIG. 3, the binaural excessive level detector 60A, 60B provides acoustic leakage detection in each of the illustrated first and second hearing devices 10A, 10B.

As mentioned above, each of the second filters 48A, 48B is intended to model the respective transfer function RA, RB from the input of the respective output transducer 44A, 44B to the output of the respective ear canal microphone 28A, 28B. The transfer functions RA, RB contain data about acoustic leakage.

The first part 60A and second part 60B of the binaural excessive level detector receives data 68A, 68B on the transfer functions of the respective second filters 48A, 48B modelling the respective transfer functions RA, RB. The first part 60A and second part 60B of the binaural excessive level detector exchanges the data 72A, 72B between the first and second hearing devices 10A, 10B through the wireless transceivers 70A, 70B. The binaural excessive level detector 60A, 60B is configured for determination of a difference between the models of the transfer functions RA, RB of the respective hearing device 10A, 10B, preferably at low frequencies, such as frequencies below 2 kHz, such as frequencies below 1 kHz, such as frequencies below 700 Hz, such as frequencies in the range between 100 Hz and 700 Hz, such as frequencies around 500 Hz.

The binaural excessive level detector 60A, 60B is configured for determination of the difference for the same settings of the first and second hearing devices 10A, 10B, and for attributing the determined difference to differences in acoustic leakage in the ear canals.

Reference values of the transfer functions RA, RB of the first and second hearing devices 10A, 10B utilized for acoustic leakage detection, may be determined, e.g. during fitting in a dispenser's office with the hearing devices 10A, 10B properly mounted without acoustic leakage at the ears of the user, or during a sealed calibration performed at the factory, and the determined reference transfer functions may subsequently be used for comparisons with the respective same transfer functions determined later in order to detect possible acoustic leakage during normal use of the binaural hearing device system 1.

In one embodiment, the binaural excessive level detector 60A, 60B is configured for determining a difference between the reference transfer functions and the respective same transfer functions determined during normal use of the binaural hearing device system 1, and for modifying the control signals 64A, 64B in accordance with the determined difference when the binaural excessive level detector 60A, 60B has determined that the processed ear canal audio signals 38A, 38B have to be attenuated to bring signals of the first and second hearing devices 10A, 10B within the dynamic range of the first and second hearing devices 10A, 10B.

For example, the binaural excessive level detector 60A, 60B may be configured for modification of the control signals 64A, 64B when the determined difference is larger than a predetermined or adjustable threshold at one or more predetermined frequencies when the binaural excessive level detector 60A, 60B and when the binaural excessive level detector 60A, 60B has determined that the processed ear canal audio signals 38A, 38B have to be attenuated to bring signals of the first and second hearing devices 10A, 10B within the dynamic range of the first and second hearing devices 10A, 10B.

Utilization of reference transfer functions has the advantage that individual differences between the anatomy of the ears of the user and individual differences between the hearing devices worn at opposite ears of the user, are taken into account.

In presence of acoustic leakage, the binaural excessive level detector 60A, 60B is configured to output modified control signals 64A, 64B to control the respective ear canal audio signal processors 36A, 36B of the first and second hearing devices 10A, 10B to attenuate the respective processed ear canal audio signals 38A, 38B to be inversely proportional to the acoustic leakage at the frequencies at which the acoustic leakage is detected, in order to provide balanced occlusion cancellation in the two ears, wherein the obtained occlusion cancellation in each ear is the sum of reduction by acoustic leakage and the active occlusion cancellation provided by subtracting the respective processed ear canal audio signal 38A, 38B from the respective processed input transducer audio signal 22A, 22B.

For example, for a specific frequency range, such as a frequency range including 500 Hz, in the event that 1 dB acoustic leakage is detected for the first hearing device 10A and 8 dB acoustic leakage is detected for the second hearing device 10B, and the binaural excessive level detector 60A, 60B has determined that the processed ear canal audio signal 38A has to be attenuated by 10 dB in the first hearing device 10A to bring the output transducer audio signal 40A within the dynamic range of the output transducer 44A, then the binaural excessive level detector 60A controls the ear canal audio signal processor 36A to attenuate the processed ear canal audio signal 38A with the required 10 dB in the hearing device 10A (since the determination relating to dynamic range is performed in presence of the 1 dB acoustic leakage), and the binaural excessive level detector 60B controls the ear canal audio signal processor 36B of the second hearing device 10B to attenuate the processed ear canal audio signal 38B with 10 dB minus the acoustic leakage difference in dB (8 dB−1 dB=7 dB), i.e. with 10 dB−7 dB=3 dB, to obtain balanced occlusion cancellation in the two ears, wherein the obtained occlusion cancellation in each ear is the sum of reduction by acoustic leakage and the active occlusion cancellation provided by subtracting the respective processed ear canal audio signal 38A, 38B from the respective processed input transducer audio signal 22A, 22B.

The attenuation may be limited by the magnitude of the signal to be attenuated. For example, if the signal is 10 dB and the desire attenuation is 15 dB, the attenuation would result in amplification of the signal. This is not desired, and instead, the signal is attenuated to 0 dB resulting in a, typically brief, unbalanced occlusion cancellation.

In another embodiment, use of reference values of the transfer functions of the first and second hearing devices 10A, 10B is avoided by assuming that the one of the first and second hearing devices 10A, 10B with the highest level of the ear canal microphone audio signal 30A, 30B at the frequencies at which acoustic leakage is detected, exhibits no acoustic leakage.

In this embodiment, the binaural excessive level detector 60A, 60B is configured for determining a difference between the transfer function, or combination of transfer functions, selected for acoustic leakage detection, of the first and second hearing devices 10A, 10B, and for modifying the control signals 64A, 64B in accordance with the determined differences when the binaural excessive level detector 60A, 60B has determined that the processed ear canal audio signals 38A, 38B have to be attenuated to bring signals of the first and second hearing devices 10A, 10B within the dynamic range of the first and second hearing devices 10A, 10B. For example, the binaural excessive level detector 60A, 60B may be configured for modification of the control signals 64A, 64B when a determined difference is larger than a predetermined or adjustable threshold at one or more predetermined frequencies.

The one of the first and second hearing devices 10A, 10B with the highest level of the ear canal microphone audio signal 30A, 30B at the frequencies at which acoustic leakage is detected, is the minuend so that the determined difference is larger than or equal to zero.

In presence of acoustic leakage, the binaural excessive level detector 60A, 60B is configured to output modified control signals 64A, 64B to control the respective ear canal audio signal processors 36A, 36B of the first and second hearing devices 10A, 10B to attenuate the respective processed ear canal audio signals 38A, 38B to be inversely proportional to the acoustic leakage at the frequencies at which the acoustic leakage is detected, in order to provide balanced occlusion cancellation in the two ears of the user, wherein the obtained occlusion cancellation in each ear is the sum of reduction by acoustic leakage and the active occlusion cancellation provided by subtracting the respective processed ear canal audio signal 38A, 38B from the respective processed input transducer audio signal 22A, 22B.

For example, for a specific frequency range, such as a frequency range including 500 Hz, in the event that the binaural excessive level detector 60A, 60B has determined that the processed ear canal audio signal 38A has to be attenuated by 10 dB in the first hearing device 10A to bring the output transducer audio signal 40A within the dynamic range of the output transducer 44A, and that the binaural excessive level detector 60A, 60B has determined a difference of 7 dB attributed to acoustic leakage of the second hearing device 10B, then the binaural excessive level detector 60A controls the ear canal audio signal processor 36A to attenuate the processed ear canal audio signal 38A with the required 10 dB in the hearing device 10A, and the binaural excessive level detector 60B controls the ear canal audio signal processor 36B of the second hearing device 10B to attenuate the processed ear canal audio signal 38B with 10 dB minus the acoustic leakage difference 7 dB=3 dB to obtain balanced occlusion cancellation in the two ears, wherein the obtained occlusion cancellation in each ear is the sum of reduction by acoustic leakage and the active occlusion cancellation provided by subtracting the respective processed ear canal audio signal 38A, 38B from the respective processed input transducer audio signal 22A, 22B.

The attenuation may be limited by the magnitude of the signal to be attenuated. For example, if the signal is 10 dB and the desired attenuation is 15 dB, the attenuation would result in amplification of the signal. This is not desired, and instead, the signal is attenuated to 0 dB resulting in a, typically brief, unbalanced occlusion cancellation. In each of, or one of, the first and second hearing devices 10A, 10B, the AOC circuit may be configured for reducing gain with the same amount, e.g. in dB, in a plurality of the frequency bands of the ear canal microphone audio signal in response to the control signals provided by the binaural excessive level detector 60A, 60B.

In each of, or one of, the first and second hearing devices 10A, 10B, the AOC circuit may be configured for reducing gain individually in a plurality of the frequency bands of the AOC circuit in response to the control signals provided by the binaural excessive level detector 60A, 60B.

In each of, or one of, the first and second hearing devices 10A, 10B, the AOC circuit may be configured for reducing gain as a function of broad-band power of the ear canal microphone audio signal in response to the control signals provided by the binaural excessive level detector 60A, 60B.

In each of, or one of, the first and second hearing devices 10A, 10B, signal processing parameters of the AOC circuit may be adjustable in accordance with user inputs to a user interface (not shown) of the binaural hearing device system 1.

FIG. 4 is a block diagram of another binaural hearing device system 1 falling under the terms of claim 1.

The binaural hearing device system 1 shown in FIG. 4 is similar to and operates in the same way as the binaural hearing device system 1 shown in FIG. 3 apart from the fact that acoustic leakage detection in the hearing device system 1 of FIG. 4 does not involve the transfer functions of the second filters 48A, 48B modelling the respective transfer functions RA, RB as in the binaural hearing device system shown in FIG. 3.

Apart from this, the binaural excessive level detector 60A, 60B performs all the functions of the binaural excessive level detector 60A, 60B of the binaural hearing device system 1 shown in FIG. 3 and receives the same inputs and provides the same outputs as the binaural excessive level detector 60A, 60B of the binaural hearing device system 1 shown in FIG. 3.

In the binaural hearing device system 1 shown in FIG. 4, each of the first and second hearing devices 10A, 10B comprises an acoustic leakage detector 74A, 74B for providing data on acoustic leakage, preferably at low frequencies, such as frequencies below 2 kHz, such as frequencies below 1 kHz, such as frequencies below 700 Hz, such as frequencies in the range between 100 Hz and 700 Hz, such as frequencies around 500 Hz.

The acoustic leakage detector 74A of the first hearing device 10A has 3 inputs that are connected so that the input transducer audio signal 14A is provided to one of the inputs, the output transducer audio signal 40A is provided to another input, and the ear canal microphone audio signal 30A is provided to the third input. The acoustic leakage detector 74A is configured for determination of a transfer function that involves the sound pressure in the ear canal space inside the fully or partly occluded ear canal, for example the transfer function from the output 14A of the input transducer 12A to the input 40A of the output transducer 44A, and/or the transfer function of a feedback loop from the input 40A of the output transducer 44A to the output 14A of the input transducer 12A, and/or the transfer function from the input 40A of the output transducer 44A to the output 30A of the ear canal microphone 28A.

Similarly, the acoustic leakage detector 74B of the second hearing device 10B has 3 inputs that are connected so that the input transducer audio signal 14B is provided to one of the inputs, the output transducer audio signal 40B is provided to another input, and the ear canal microphone audio signal 30B is provided to the third input. The acoustic leakage detector 74B is configured for determination of a transfer function that involves the sound pressure in the ear canal space inside the fully or partly occluded ear canal, for example the transfer function from the output 14B of the input transducer 12B to the input 40B of the output transducer 44B, and/or the transfer function of a feedback loop from the input 40B of the output transducer 44B to the output 14B of the input transducer 12B, and/or the transfer function from the input 40B of the output transducer 44B to the output 30B of the ear canal microphone 28B.

The acoustic leakage detectors 74A, 74B are configured for determination of the same respective selected transfer function, or a same combination of respective selected transfer functions, of the respective first and second hearing devices 10A, 10B with the same settings of the first and second hearing devices 10A, 10B.

Each of the acoustic leakage detectors 74A, 74B has an output 76A, 76B for outputting data on the determined transfer functions to the binaural excessive level detector 60A, 60B, and the binaural excessive level detector 60A, 60B is configured for processing the determined transfer functions in order to determine possible acoustic leakage.

Reference values of the transfer functions of the first and second hearing devices 10A, 10B utilized for acoustic leakage detection, may be determined, e.g. during fitting in a dispenser's office with the hearing devices 10A, 10B properly mounted without acoustic leakage at the ears of the user, or during a sealed calibration performed at the factory, and the determined reference transfer functions may subsequently be used for comparisons with the respective transfer functions determined later in order to detect possible acoustic leakage during normal use of the binaural hearing device system 1.

In one embodiment, the binaural excessive level detector 60A, 60B is configured for determining a difference between the reference transfer functions and the respective transfer functions determined during normal use of the binaural hearing device system 1, and for modifying the control signals 64A, 64B in accordance with the determined differences when the binaural excessive level detector 60A, 60B has determined that the processed ear canal audio signals 38A, 38B have to be attenuated to bring signals of the first and second hearing devices 10A, 10B within the dynamic range of the first and second hearing devices 10A, 10B.

For example, the binaural excessive level detector 60A, 60B may be configured for modification of the control signals 64A, 64B when the determined difference is larger than a predetermined or adjustable threshold at one or more predetermined frequencies when the binaural excessive level detector 60A, 60B and when the binaural excessive level detector 60A, 60B has determined that the processed ear canal audio signals 38A, 38B have to be attenuated to bring signals of the first and second hearing devices 10A, 10B within the dynamic range of the first and second hearing devices 10A, 10B.

Utilization of reference transfer functions has the advantage that individual differences between the anatomy of the ears of the user and individual differences between the hearing devices worn at opposite ears of the user, are taken into account.

In presence of acoustic leakage, the binaural excessive level detector 60A, 60B is configured to output modified control signals 64A, 64B to control the respective ear canal audio signal processors 36A, 36B of the first and second hearing devices 10A, 10B to attenuate the respective processed ear canal audio signals 38A, 38B to be inversely proportional to the acoustic leakage at the frequencies at which the acoustic leakage is detected, in order to provide balanced occlusion cancellation in the two ears, wherein the obtained occlusion cancellation in each ear is the sum of reduction by acoustic leakage and the active occlusion cancellation provided by subtracting the respective processed ear canal audio signal 38A, 38B from the respective processed input transducer audio signal 22A, 22B.

For example, for a specific frequency range, such as a frequency range including 500 Hz, in the event that 1 dB acoustic leakage is detected for the first hearing device 10A and 8 dB acoustic leakage is detected for the second hearing device 10B, and the binaural excessive level detector 60A, 60B has determined that the processed ear canal audio signal 38A has to be attenuated by 10 dB in the first hearing device 10A to bring the output transducer audio signal 40A within the dynamic range of the output transducer 44A, then the binaural excessive level detector 60A controls the ear canal audio signal processor 36A to attenuate the processed ear canal audio signal 38A with the required 10 dB in the hearing device 10A (since the detection is performed in presence of the 1 dB acoustic leakage), and the binaural excessive level detector 60B controls the ear canal audio signal processor 36B of the second hearing device 10B to attenuate the processed ear canal audio signal 38B with 10 dB minus the acoustic leakage difference in dB (8 dB−1 dB=7 dB), i.e. with 10 dB−7 dB=3 dB to obtain balanced occlusion cancellation in the two ears, wherein the obtained occlusion cancellation in each ear is the sum of reduction by acoustic leakage and the active occlusion cancellation provided by subtracting the respective processed ear canal audio signal 38A, 38B from the respective processed input transducer audio signal 22A, 22B.

The attenuation may be limited by the magnitude of the signal to be attenuated. For example, if the signal is 10 dB and the attenuation is 15 dB, the attenuation would result in amplification of the signal. This is not desired, and instead, the signal is attenuated to 0 dB resulting in a, typically brief, unbalanced occlusion cancellation.

In another embodiment, use of reference values of the transfer functions of the first and second hearing devices 10A, 10B is avoided by assuming that the one of the first and second hearing devices 10A, 10B with the highest level of the ear canal microphone audio signal 30A, 30B at the frequencies at which acoustic leakage is detected, exhibits no acoustic leakage.

In this embodiment, the binaural excessive level detector 60A, 60B is configured for determining a difference between the transfer function, or combination of transfer functions, selected for acoustic leakage detection, of the first and second hearing devices 10A, 10B, and for modifying the control signals 64A, 64B in accordance with the determined differences when the binaural excessive level detector 60A, 60B has determined that the processed ear canal audio signals 38A, 38B have to be attenuated to bring signals of the first and second hearing devices 10A, 10B within the dynamic range of the first and second hearing devices 10A, 10B. For example, the binaural excessive level detector 60A, 60B may be configured for modification of the control signals 64A, 64B when a determined difference is larger than a predetermined or adjustable threshold at one or more predetermined frequencies.

The one of the first and second hearing devices 10A, 10B with the highest level of the ear canal microphone audio signal 30A, 30B at the frequencies at which acoustic leakage is detected, is the minuend so that the determined difference is larger than or equal to zero. The acoustic leakage detectors 74A, 74B are configured for determination of the same respective selected transfer function, or a same combination of respective selected transfer functions, of the respective first and second hearing devices 10A, 10B with the same settings of the first and second hearing devices 10A, 10B.

In presence of acoustic leakage, the binaural excessive level detector 60A, 60B is configured to output modified control signals 64A, 64B to control the respective ear canal audio signal processors 36A, 36B of the first and second hearing devices 10A, 10B to attenuate the respective processed ear canal audio signals 38A, 38B to be inversely proportional to the acoustic leakage at the frequencies at which the acoustic leakage is detected, in order to provide balanced occlusion cancellation in the two ears of the user, wherein the obtained occlusion cancellation in each ear is the sum of reduction by acoustic leakage and the active occlusion cancellation provided by subtracting the respective processed ear canal audio signal 38A, 38B from the respective processed input transducer audio signal 22A, 22B.

For example, for a specific frequency range, such as a frequency range including 500 Hz, in the event that the binaural excessive level detector 60A, 60B has determined that the processed ear canal audio signal 38A has to be attenuated by 10 dB in the first hearing device 10A to bring the output transducer audio signal 40A within the dynamic range of the output transducer 44A, and that the binaural excessive level detector 60A, 60B has determined a difference of 7 dB attributed to acoustic leakage of the second hearing device 10B, then the binaural excessive level detector 60A controls the ear canal audio signal processor 36A to attenuate the processed ear canal audio signal 38A with the required 10 dB in the hearing device 10A, and the binaural excessive level detector 60B controls the ear canal audio signal processor 36B of the second hearing device 10B to attenuate the processed ear canal audio signal 38B with 10 dB minus the acoustic leakage difference 7 dB=3 dB to obtain balanced occlusion cancellation in the two ears, wherein the obtained occlusion cancellation in each ear is the sum of reduction by acoustic leakage and the active occlusion cancellation provided by subtracting the processed ear canal audio signal 38A, 38B from the respective processed input transducer audio signal 22A, 22B.

The attenuation may be limited by the magnitude of the signal to be attenuated. For example, if the signal is 10 dB and the attenuation is 15 dB, the attenuation would result in amplification of the signal. This is not desired, and instead, the signal is attenuated to 0 dB resulting in a, typically brief, unbalanced occlusion cancellation.

FIG. 5 is a block diagram of yet another binaural hearing device system 1 falling under the terms of claim 1.

The binaural hearing device system 1 shown in FIG. 5 is similar to, and operates in the same way as, the binaural hearing device system 1 shown in FIG. 3 apart from the fact that the binaural hearing device system 1 of FIG. 5 comprises a wearable device 10C, namely a smartphone 10C, wherein the smartphone 10C comprises the binaural excessive level detector 60C.

The binaural excessive level detector 60C performs all the functions of the binaural excessive level detector 60A, 60B of the binaural hearing device system 1 shown in FIG. 3 and receives the same inputs and provides the same outputs as the binaural excessive level detector 60A, 60B of the binaural hearing device system 1 shown in FIG. 3.

In the binaural hearing device system 1 shown in FIG. 5, each of the first hearing device 10A, the second hearing device 10B, and the smartphone 10C, comprises a transceiver 70A, 70B, 70C that is configured for communication with each other in accordance with the Bluetooth Low Energy standard protocol so that the first and second hearing devices 10A, 10B and the smartphone 10C of the binaural hearing device system shown in FIG. 5, are interconnected in a Bluetooth Low Energy wireless network for transmission of the control signals 64A, 64B from the binaural excessive level detector 60C of the smartphone 10C to the first and second hearing devices 10A, 10B and for transmission of the output signals 56A, 56B of the respective body conducted sound detectors 54A, 54B and the output signals 62A, 62B of the respective signal level detectors 58A, 58B and the output signals 68A, 68B containing data on the transfer functions of the respective second filters 48A, 48B modelling the respective transfer functions RA, RB of the respective second filters 48A, 48B from the first and second hearing devices 10A, 10B to the binaural excessive level detector 60C of the smartphone 10C.

The smartphone 10C further comprises a user interface (not shown) that is configured for user control of the binaural hearing device 1, e.g. for selection of a specific signal processing algorithm, and/or for adjustment of a signal processing parameter, such as the volume, the threshold of the binaural excessive level detector 10C, etc.

FIG. 6 is a block diagram of yet another binaural hearing device system 1 falling under the terms of claim 1.

The binaural hearing device system 1 shown in FIG. 6 is similar to, and operates in the same way as, the binaural hearing device system 1 shown in FIG. 4 apart from the fact that the binaural hearing device system 1 of FIG. 6 comprises a wearable device 10C, namely a smartphone 10C, wherein the smartphone 10C comprises the binaural excessive level detector 60C.

The binaural excessive level detector 60C performs all the functions of the binaural excessive level detector 60A, 60B of the binaural hearing device system 1 shown in FIG. 4 and receives the same inputs and provides the same outputs as the binaural excessive level detector 60A, 60B of the binaural hearing device system 1 shown in FIG. 4.

In the binaural hearing device system 1 shown in FIG. 6, each of the first hearing device 10A, the second hearing device 10B, and the smartphone 10C, comprises a transceiver 70A, 70B, 70C that is configured for communication with each other in accordance with the Bluetooth Low Energy standard protocol so that the first and second hearing devices 10A, 10B and the smartphone 10C of the binaural hearing device system shown in FIG. 6, are interconnected in a Bluetooth Low Energy wireless network for transmission of the control signals 64A, 64B from the binaural excessive level detector 60C of the smartphone 10C to the first and second hearing devices 10A, 10B and for transmission of the output signals 56A, 56B of the respective body conducted sound detectors 54A, 54B and the output signals 62A, 62B of the respective signal level detectors 58A, 58B and the output signals 68A, 68B containing data on the transfer functions of the respective second filters 48A, 48B modelling the respective transfer functions RA, RB of the respective second filters 48A, 48B from the first and second hearing devices 10A, 10B to the binaural excessive level detector 60C of the smartphone 10C.

The smartphone 10C further comprises a user interface (not shown) that is configured for user control of the binaural hearing device 1, e.g. for selection of a specific signal processing algorithm, and/or for adjustment of a signal processing parameter, such as the volume, the threshold of the binaural excessive level detector 10C, etc.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A binaural hearing system comprising a first hearing device and a second hearing device, each of which comprises:

an input transducer for provision of an input transducer audio signal;

a transducer audio signal processor configured to process the input transducer audio signal into a processed input transducer audio signal;

an ear canal microphone for provision of an ear canal microphone audio signal based on sound received inside an ear canal of a user wearing the binaural hearing device;

an ear canal audio signal processor configured to process the ear canal microphone audio signal into a processed ear canal audio signal;

a first signal combiner configured to combine the processed input transducer audio signal with the processed ear canal audio signal to obtain an output transducer audio signal;

a signal level detector configured to determine a signal level of (1) the output transducer audio signal or (2) an audio signal included in formation of the output transducer audio signal, wherein the signal level detector is configured to provide an output signal based on the determined signal level; and an output transducer configured to provide an acoustic sound signal for emission towards an eardrum of the user based on the output transducer audio signal;

wherein the binaural hearing system further comprises a binaural excessive level detector connected to the signal level detector of the first hearing device and the signal level detector of the second hearing device, and wherein the binaural excessive level detector is configured to output (1) a first control signal for the ear canal audio signal processor of the first hearing device and (2) a second control signal for the ear canal audio signal processor of the second hearing device, based at least in part on the signal level determined by the signal level detector of the first hearing device and/or the signal level determined by the signal level detector of the second hearing device; and wherein the ear canal audio signal processor in the first hearing device is configured to attenuate the ear canal microphone audio signal in the first hearing device based on the first control signal, and/or the ear canal audio signal processor in the second hearing device is configured to attenuate the ear canal microphone audio signal in the second hearing device based on the second control signal.

2. The binaural hearing system according to claim 1, wherein the ear canal audio signal processor in each of the first and second hearing devices is configured to process the respective ear canal microphone audio signal based on the respective one of the first and second control signals of the binaural excessive level detector such that each of the processed ear canal audio signals is attenuated by a same amount.

3. The binaural hearing system according to claim 1, further comprising a wearable device that comprises the first and second hearing devices and the binaural excessive level detector.

4. The binaural hearing system according to claim 1, wherein the first hearing device comprises a first part of the binaural excessive level detector and the second hearing device comprises a second part of the binaural excessive level detector;

wherein the first part of the binaural excessive level detector is connected to the signal level detector of the first hearing device and the signal level detector of the second hearing device, and is configured to output the first control signal to the ear canal audio signal processor of the first hearing device based on the determined signal levels; and wherein the second part of the binaural excessive level detector is connected to the signal level detector of the first hearing device and the signal level detector of the second hearing device, and is configured to output the second control signal to the ear canal audio signal processor of the second hearing device based on the determined signal levels.

5. The binaural hearing system according to claim 1, wherein the binaural excessive level detector is configured to detect excessive level by comparing each of the output signals of the signal level detectors with a predetermined threshold.

6. The binaural hearing system according to claim 5, wherein when at least one of the output signals exceeds the predetermined threshold, the ear canal audio signal processor of the first hearing device is configured to attenuate the processed ear canal audio signal of the first hearing device, and/or the ear canal audio signal processor of the second hearing device is configured to attenuate the processed ear canal audio signal of the second hearing device.

7. The binaural hearing system according to claim 1, wherein the ear canal audio signal processor in each of the first and second hearing devices is configured to cause that at least one of the processed ear canal audio signals to attenuate by an amount required to keep signals of the first hearing device and/or the second hearing device within a dynamic range of the first hearing device and/or the second hearing device.

8. The binaural hearing system according to claim 1, further comprising at least one body conducted sound detector that is configured to detect body conducted sound in the ear canal(s) of the user of the binaural hearing system.

9. The binaural hearing system according to claim 1, wherein the first hearing device comprises a first body conducted sound detector configured to detect body conducted sound in one of the ear canals of the user; and wherein the second hearing device comprises a second body conducted sound detector configured to detect body conducted sound in another one of the ear canals of the user.

10. The binaural hearing system according to claim 8, wherein the at least one body conducted sound detector is configured to provide a detector output to the binaural excessive level detector, the detector output indicating whether body conducted sound has been detected in the ear(s) of the user.

11. The binaural hearing system according to claim 10, wherein the binaural excessive level detector is configured to disable the combining of the processed input transducer audio signal with the processed ear canal audio signal in the first hearing device and/or the second hearing device, based on the detector output.

12. The binaural hearing system according to claim 8, wherein the at least one body conducted sound detector is configured to separate the body conducted sound from external sound using a blind source separation (BSS) algorithm.

13. The binaural hearing system according to claim 8, wherein the at least one body conducted sound detector comprises an acceleration sensor and/or a vibration sensor.

14. The binaural hearing system according to claim 8, wherein the at least one body conducted sound detector comprises a binaural impact sound detector that is configured to detect impact sound occurring simultaneously in both ears of the user.

15. The binaural hearing system according to claim 1, wherein each of the first and second hearing devices comprises an acoustic leakage detector configured to determine at least one transfer function.

16. The binaural hearing system according to claim 15, wherein the transfer function is associated with a path from an input of the output transducer to an output of the input transducer, from an input of the output transducer to an output of the ear canal microphone, or from the output of the input transducer to the input of the output transducer.

17. The binaural hearing system according to claim 1, wherein each of the first and second hearing devices comprises a filter configured to model a transfer function that is associated with a path from an input of the output transducer to an output of the ear canal microphone, wherein an output signal provided by the filter corresponds to a part of the ear canal audio signal originating from the output transducer.

18. The binaural hearing system according to claim 1, wherein the binaural excessive level detector is configured to determine an acoustic leakage in at least one of the ear canals.

19. The binaural hearing system according to claim 18, wherein the binaural excessive level detector is configured to cause a signal level reduction for at least one of the first and second hearing devices, the signal level reduction being inversely proportional to the determined acoustic leakage.

20. The binaural hearing system according to claim 18, configured to provide a balanced occlusion cancellation based on the determined acoustic leakage.

* * * * *